US009478849B2

(12) United States Patent
Guan et al.

(10) Patent No.: US 9,478,849 B2
(45) Date of Patent: Oct. 25, 2016

(54) ANTENNA DEVICE

(75) Inventors: Ning Guan, Sakura (JP); Hiroiku Tayama, Sakura (JP)

(73) Assignee: FUJIKURA LTD., Tokyo (JP)

( * ) Notice: Subject to any disclaimer, the term of this patent is extended or adjusted under 35 U.S.C. 154(b) by 467 days.

(21) Appl. No.: 13/474,893

(22) Filed: May 18, 2012

(65) Prior Publication Data

US 2012/0229344 A1 Sep. 13, 2012

Related U.S. Application Data

(63) Continuation of application No. PCT/JP2010/070728, filed on Nov. 19, 2010.

(30) Foreign Application Priority Data

Nov. 19, 2009 (JP) ..... 2009-263518
Feb. 25, 2010 (JP) ..... 2010-040740

(51) Int. Cl.

| | |
|---|---|
| ***H01Q 1/38*** | (2006.01) |
| ***H01Q 7/00*** | (2006.01) |
| ***H01Q 9/04*** | (2006.01) |
| ***H01Q 1/36*** | (2006.01) |
| ***H01Q 5/378*** | (2015.01) |

(52) U.S. Cl.

CPC ..... *H01Q 1/38* (2013.01); *H01Q 1/36* (2013.01); *H01Q 5/378* (2015.01); *H01Q 7/00* (2013.01); *H01Q 9/0421* (2013.01)

(58) Field of Classification Search

USPC ..... 343/700 MS, 702
See application file for complete search history.

(56) References Cited

U.S. PATENT DOCUMENTS

| | | | | |
|---|---|---|---|---|
| 5,313,216 | A * | 5/1994 | Wang | H01Q 9/27 343/700 MS |
| 7,248,220 | B2 * | 7/2007 | Futamata | H01Q 5/378 343/700 MS |
| 2003/0146878 | A1 * | 8/2003 | Mikkola | H01Q 1/243 343/702 |
| 2004/0075616 | A1 | 4/2004 | Endo et al. | |
| 2004/0246180 | A1 | 12/2004 | Okado | |
| 2005/0007296 | A1 | 1/2005 | Endo et al. | |
| 2007/0139285 | A1 | 6/2007 | Maruyama et al. | |
| 2008/0042916 | A1 | 2/2008 | Ma | |

(Continued)

FOREIGN PATENT DOCUMENTS

| | | | |
|---|---|---|---|
| CN | 1518783 | A | 8/2004 |
| CN | 1871743 | A | 11/2006 |
| EP | 0450881 | A2 | 10/1991 |

(Continued)

OTHER PUBLICATIONS

Office Action issued by Japanese Patent Office in Japanese Patent Application No. 2011-541969 dated Sep. 17, 2013.

(Continued)

*Primary Examiner* — Hoang V Nguyen
*Assistant Examiner* — Hai Tran
(74) *Attorney, Agent, or Firm* — Sughrue Mion, PLLC

(57) ABSTRACT

An antenna device (100) includes an antenna element (101) and an electric conductor plate (102) provided so as to face the antenna element (101). The antenna element (101) and the electric conductor plate (102) are short-circuited by a short-circuit section (104). The antenna element (101) is connected with both of external and internal electric conductors (122) and (123) constituting a feed line (121).

5 Claims, 13 Drawing Sheets

(56) References Cited

U.S. PATENT DOCUMENTS

| | | | | |
|---|---|---|---|---|
| 2008/0180333 | A1* | 7/2008 | Martiskainen | H01Q 1/243 343/722 |
| 2008/0180342 | A1* | 7/2008 | Kerselaers | H01Q 9/285 343/795 |

FOREIGN PATENT DOCUMENTS

| | | | |
|---|---|---|---|
| FR | 2786902 | A1 | 6/2000 |
| JP | 2003-60442 | A | 2/2003 |
| JP | 2004-80108 | A | 3/2004 |
| JP | 2004-215061 | A | 7/2004 |
| JP | 2006-93977 | A | 4/2006 |
| JP | 2006-129431 | A | 5/2006 |
| TW | 200812150 | A | 3/2008 |

OTHER PUBLICATIONS

International Search Report for PCT/JP2010/070728 dated Feb. 22, 2011.

Office Action issued by Chinese Patent Office in Chinese Application No. 201080051684.8 mailed May 5, 2014.

Search Report issued by European Patent Office in European Application No. 10831664.7 mailed Jul. 14, 2014.

* cited by examiner

ANTENNA DEVICE

CROSS-REFERENCE TO RELATED APPLICATIONS

This application is a Continuation of PCT International Application Serial No. PCT/JP2010/070728 filed Nov. 19, 2010.

This application is based upon and claims the benefits of priority from prior Japanese Patent Application No. 2009-263518 filed Nov. 19, 2009 and Japanese Patent Application No. 2010-040740 filed Feb. 25, 2010.

TECHNICAL FIELD

The present invention relates to an antenna device including an antenna element and an electric conductor plate.

BACKGROUND ART

Antennas have been long used as devices for converting a high-frequency current into an electromagnetic ray and an electromagnetic ray into a high-frequency current. The antennas are categorized into subgroups such as linear antennas, planar antennas, and solid antennas, based on their shapes. The linear antennas are further categorized into subgroups such as a dipole antenna, a monopole antenna, and a loop antenna, based on their structures.

The dipole antenna is a linear antenna having a very simple structure and is widely used as a base-station antenna to this day. The monopole antenna, which requires only half a length of the dipole antenna, is frequently used as an antenna for a mobile device.

In principle, the monopole antenna and the loop antenna require bottom boards infinitely extended. However, in a mobile device with a limited space, it is difficult to provide a bottom board having a sufficient size. Also, in a case where a metal member is provided near the antenna, an input impedance of the antenna is greatly changed. This gives rise to a problem that the antenna and a feed line cannot be matched in impedance.

The patent literature 1 discloses an art that stabilizes an input impedance by use of an electric conductor pattern provided on a planar sheet and a bottom board facing the electric conductor pattern. The patent literature 2 discloses an antenna in which a reflective plate of a display or a display frame serves as a bottom board so that it is not necessary to independently provide a bottom plate.

CITATION LIST

Patent Literature

Patent Literature 1

Japanese Patent Application Publication, Tokukai, No. 2004-80108 A (Publication Date: Mar. 11, 2004)

Patent Literature 2

Japanese Patent Application Publication, Tokukai, No. 2003-60442 A (Publication Date: Feb. 28, 2003)

SUMMARY OF INVENTION

Technical Problem

It is required for an antenna device built in a mobile device to have (1) a small size, (2) a stable input impedance, and (3) a high radiant gain. The reason why the antenna device built in the mobile device has to have the high radiant gain is because it is necessary to take into account a decay in radiant gain caused by a metal member provided in a housing of the mobile device.

Antenna devices of the patent literatures 1 and 2 meet requirements that (1) they should have small sizes and (2) they should have stable input impedances, but fail to meet requirement that (3) they should have high radiant gains.

The present invention is made in view of the problem, and an object of the present invention is to realize an antenna device that achieves both a stable input impedance and a high radiant gain without causing an increase in size.

Solution to Problem

In order to attain the object, an antenna device of the present invention includes: an antenna element provided in a given plane; and an electric conductor plate provided so as to face the given plane, the antenna element and the electric conductor plate being short-circuited, and the antenna element being connected with a pair of electric conductors constituting a feed line.

With the arrangement, the antenna element and the electric conductor plate are short-circuited, and the antenna element is connected with the pair of electric conductors constituting the feed line. As such, the electric conductor plate also has the function of the antenna element. This makes it possible to obtain a radiant gain higher than in a case where no electric conductor plate is provided.

Also, because the electric conductor plate is provided so as to face the antenna element, the antenna element is less likely to be affected by a metal member even in a case where the metal member is provided on a side of the electric conductor plate which side is opposite to an antenna element side. That is, it is possible for the antenna device to have an input impedance more stable than in a case where no electric conductor plate is provided.

Further, because the electric conductor plate is provided so as to face the antenna element, it is also possible to obtain the above effect without causing a size increase as a result of providing the electric conductor plate.

Advantageous Effects of Invention

An antenna device of the present invention is an antenna device including an antenna element provided in a given plane and an electric conductor plate provided so as to face the given plane, the antenna element and the electric conductor plate being short-circuited, and the antenna element being connected with a pair of electric conductors constituting a feed line. With the antenna device thus arranged, it is possible to realize both of stabilization of an input impedance and improvement of a radiant gain without causing a size increase.

DESCRIPTION OF EMBODIMENTS

Embodiment 1

Figure 1:
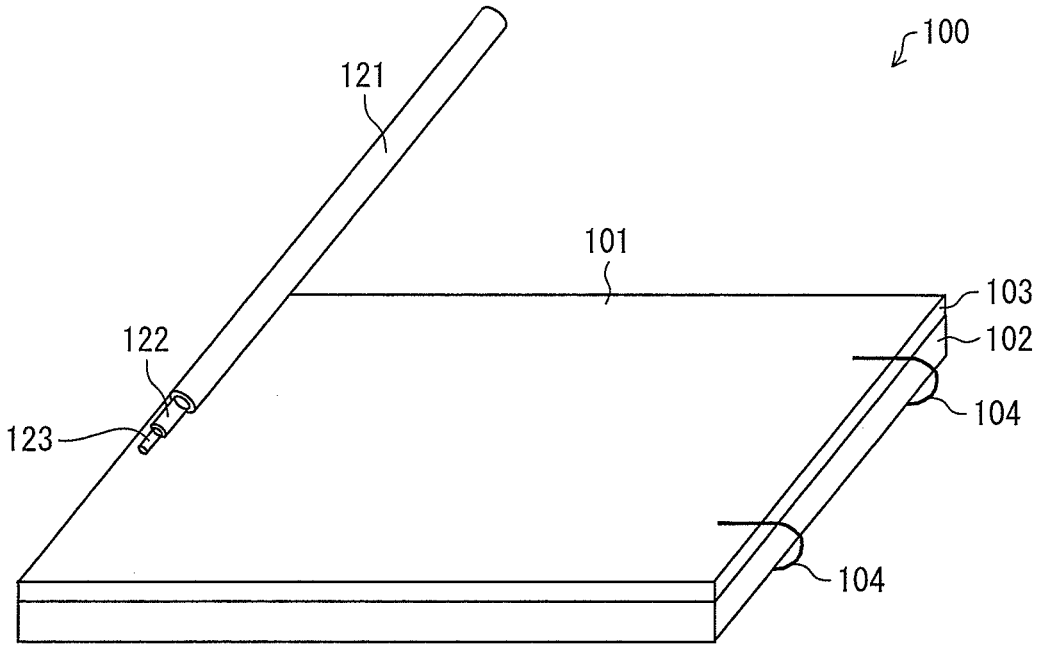
FIG. 1 is a perspective view showing how an antenna device is arranged in accordance with a first embodiment of the present invention.

With reference to FIG. 1, the following description discusses how an antenna device 100 is arranged in accordance with Embodiment 1 of the present invention. FIG. 1 is a perspective view showing how the antenna device 1 is arranged.

An antenna device 100 includes (i) an antenna element (planar antenna) 101 provided in a given plane (hereinafter referred to as an "antenna element formation plane") and (ii) an electric conductor plate 102 provided so as to face the antenna element formation plane (see FIG. 1).

The antenna element 101 and the electric conductor plate 102 are thus provided so as to face each other as shown in FIG. 1. This is because such an arrangement allows the antenna device 1 to be downsized, and allows an improvement in stability of an input impedance (later described). Note that a dielectric sheet 103 is sandwiched between the antenna element 101 and the electric conductor plate 102 (see FIG. 1), so as to prevent a direct electric connection between opposed surfaces of respective of the antenna element 101 and the electric conductor plate 102.

As shown in FIG. 1, the antenna device 100 further includes a short-circuit section 104, so that the antenna element 101 and the electric conductor plate 102 are short-circuited via the short-circuit section 104. The antenna element 101 is connected with both of a pair of electric conductors which constitute a feed line 121. Specifically, as shown in FIG. 1, the antenna element 101 is connected with outer and inner electric conductors 122 and 123 of a coaxial cable serving as the feed line 121.

Therefore, the electric conductor plate 102 also has the function of the antenna element 101. That is, the antenna element 101 and the electric conductor plate 102 work together to serve as one (1) antenna element, in response to a high-frequency current supplied via the feed line 121. As such, it is possible to obtain a radiant gain higher than that of the antenna device 101 alone. Note that it is preferable to determine the following (i) and (ii) from a perspective of increasing the radiant gain but preventing an increase in VSWR as much as possible; (i) how many short-circuit section(s) 104 is provided and (ii) where the short-circuit section(s) 104 is provided. Arrangement examples of the antenna element 101 are later described with reference to other drawings.

It is desirable that an orthogonal projection of the electric conductor plate 102 with respect to the antenna element formation plane includes the antenna element 101. In plain words, it is preferable that the electric conductor plate 102 covers over the antenna element 101 when the electric conductor plate 102 is viewed from a side opposite to an antenna element 101 side. This allows a further increase in the radiant gain and a decrease in fluctuation in input impedance of the antenna device 100 which is caused in a case where an electric conductor is provided on the side opposite to the antenna element 101 side of the electric conductor plate 102.

Embodiment 2

Figure 2:
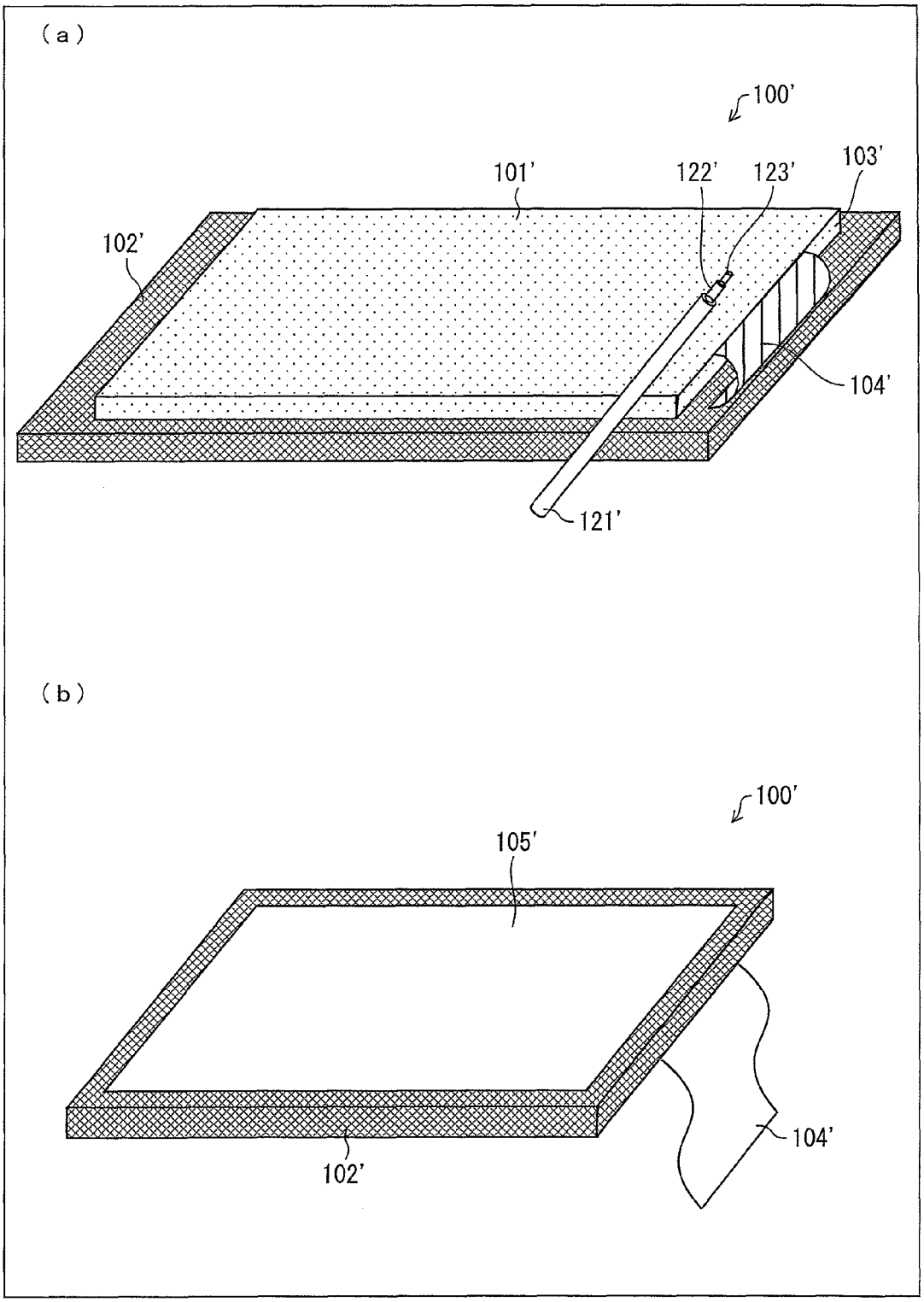
FIG. 2 is a perspective view showing how an antenna device is arranged in accordance with a second embodiment of the present invention.

With reference to FIG. 2, the following description discusses how an antenna device 100' is arranged in accordance with Embodiment 2 of the present invention. (a) of FIG. 2 is a perspective view showing the antenna device 100' from a front surface side, whereas (b) of FIG. 2 is a perspective view showing the antenna device 100' from a rear surface side. Note that (i) a front surface side of the antenna device 100' corresponds to a rear surface side of a liquid crystal display (later described) and (ii) a rear surface side of the antenna device 100' corresponds to a front side of a display device (later described)).

The antenna device 100' is an antenna device integrated with a liquid crystal display (see (a) and (b) of FIG. 2). According to the antenna device 100', a rear surface of a metal frame 102' holding a liquid crystal panel 105' is used as the electric conductor plate 102 of Embodiment 1. As shown in (a) of FIG. 2, a dielectric sheet 103' is sandwiched between the metal frame 102' and an antenna element 101'. There is no direct electric connection between opposed surfaces of respective of the metal frame 102' and the antenna element 101'. The metal frame 102' is connected with a constant-voltage source such as an open-circuit voltage or an earth electric potential.

The antenna device 100' further includes a flexible cable 104', and the antenna element 101' and the metal frame 102' are short-circuited via the flexible capable 104' (see (a) of FIG. 2). The antenna element 101' is connected with both of a pair of electric conductors constituting a feed line 121'. Specifically, as shown in (a) of FIG. 2, the antenna element 101' is connected with outer and inner electric conductors 122' and 123' of a coaxial cable serving as the feed line 121'.

Therefore, the metal frame 102' also has the function of the antenna element 101'. That is, the metal frame 102' and the antenna element 101' work together to serve as one (1) antenna element, in response to a high-frequency current supplied via the feed line 121'. As such, it is possible to obtain a radiant gain higher than that of the antenna element 101' alone.

Note that the metal frame 102', which holds the liquid crystal panel 105', generally has a size greater than the antenna element 101' (see (a) of FIG. 2). This arrangement is advantageous from (i) a perspective of increasing the radiant gain and (ii) a perspective of decreasing a fluctuation in input impedance. In a device such as a laptop personal computer or a mobile telephone terminal, it is rare that a metal member is provided behind a liquid crystal display. It follows that it is also rare that there occurs a fluctuation in input impedance by the antenna element 101' coming close to the metal member.

Arrangement Example of Antenna Element

The following description will discuss arrangement examples of the antenna element, with reference to FIGS. 3 through 8. Note that each antenna element described below is a planar antenna suitably used as the antenna element 101 in the antenna device 100 of Embodiment 1 or as the antenna element 101' in the antenna device 100' of Embodiment 2.

Arrangement Example 1

Figure 3:
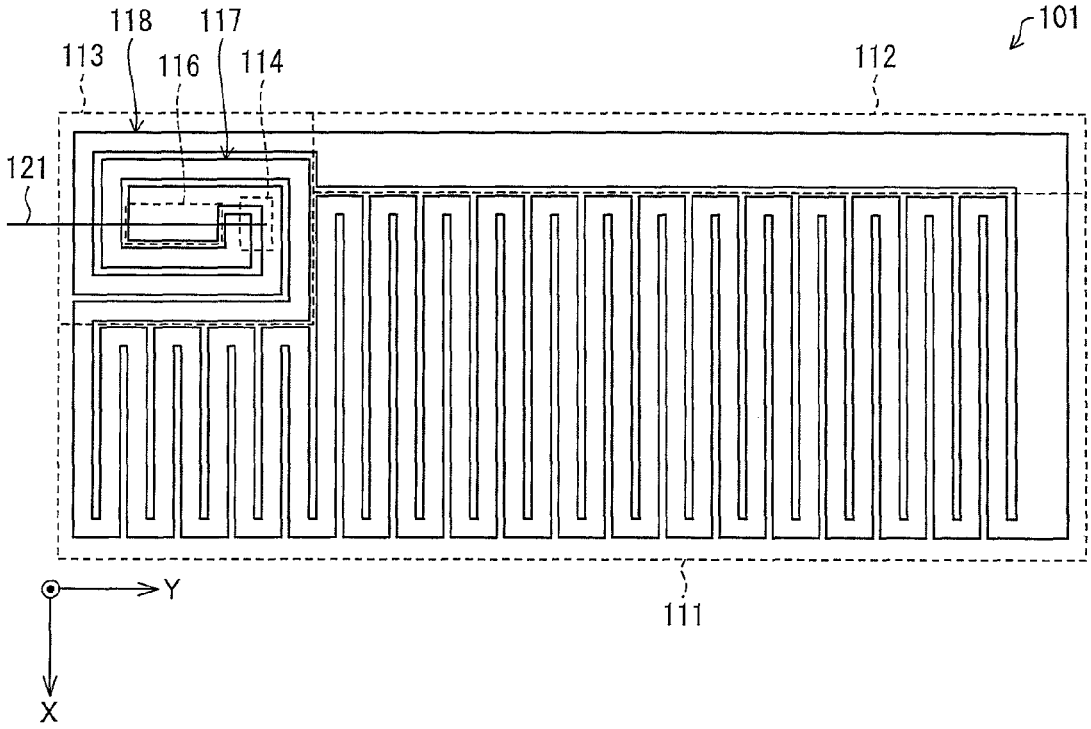
FIG. 3 is a plan view showing a first arrangement example of the planar antenna included in each of the antenna devices shown in respective FIGS. 1 and 2.

FIG. 3 is a plan view showing a first arrangement example of the antenna element.

An antenna element 101 shown in FIG. 3 has an electrically conductive path continuing from its one end part to the other end part. In view of the fact that the antenna element 101 has the electrically conductive path thus continuing, it can be said that the antenna element 101 is provided in a loop manner, like a conventional loop antenna. Further, the antenna element 101 is provided in a single plane. The antenna element 101 can be made of a material such as an electrically conductive wire or an electrically conductive film.

According to the antenna element 101, a wind section 113 is made up of a first root section 117 including the one end part and a second root section 118 including the other end part. An intermediate section between the first and second root sections 117 and 118 constitutes a first antenna section 111 and a second antenna section 112. In an example shown in FIG. 1, the first antenna section 111 has a meander shape, whereas the second antenna section 112 has a linear shape.

The antenna element 101 has the following size: a length in a crosswise direction (i.e., Y axis direction) of a sheet on which FIG. 3 is illustrated is 70 mm; and a length in a lengthwise direction (i.e., X axis direction) of the sheet is 30 mm. That is, one (1) antenna element 101 having the continuous electrically conductive path is provided so that the first antenna section 111, the second antenna section 112, and the wind section 113 are provided in a rectangular region of a size of 70 mm×30 mm.

A feed section 114 is provided in the wind section 113, i.e., in the first and second root sections 117 and 118 of the antenna element 101. The feed section 114 is connected with a feed line 121. The antenna element 101 receives power via the feed line 121.

According to the wind section 113, the first root section 117 of the antenna element 101 is drawn out in a leftward direction (i.e., a negative direction of the Y axis) of the sheet on which FIG. 3 is shown, whereas the second root section 118 of the antenna element 101 is drawn out in a rightward direction (i.e., a positive direction of the Y axis) of a sheet on which FIG. 1 is shown. That is, the first and second root sections 117 and 118 are drawn out in respective opposite directions. Note, here, that the direction in which the first root section 117 is drawn out is defined as a direction in which the first root section 117 is drawn out from the wind section 113, i.e., a direction in which a linear part (a linear part **117*o*5 in FIG. 4) extends. Out of linear parts constituting the first root section 117, such a linear part is the farthest one from one end of the antenna element 101. The direction in which the second root section 118** is drawn out is similarly defined.

Note also that the direction in which the first root section 117 of the antenna element 101 is drawn out is a direction in which the feed line 121 extends from the feed section 114, i.e., the leftward direction (i.e., the negative direction of the Y axis) of the sheet on which FIG. 3 is illustrated, whereas the direction in which the second root section 118 of the antenna element 101 is drawn out is a direction opposite to the direction in which the feed line 121 extends from the feed section 114 (i.e., in the leftward direction of the sheet).

Specifically, according to the wind section 113, a direction in which the first root section 117 extends from the one end of the antenna element 101 is changed from a direction (i) to a direction (v) in this order: (i) the leftward direction (i.e., the negative direction of the Y axis) of the sheet on which FIG. 3 is illustrated, (ii) an upward direction (i.e., a negative direction of the X axis) of the sheet, (iii) the rightward direction (i.e., the positive direction of the Y axis) of the sheet, (vi) a downward direction (i.e., a positive direction of the X axis) of the sheet, and (v) the leftward direction (i.e., the negative direction of the Y axis, the drawing direction) of the sheet. On the other hand, a direction in which the second root section 118 extends from the other end of the antenna element 101 is changed from a direction (vi) to a direction (x) in this order; (vi) the rightward direction (i.e., the positive direction of the Y axis) of the sheet on which FIG. 3 is illustrated, (vii) the downward direction (i.e., the positive direction of the X axis) of the sheet, (viii) the leftward direction (i.e., the negative direction of the Y axis) of the sheet, (ix) the upward direction (i.e., the negative direction of the X axis) of the sheet, and (x) the rightward direction (i.e., the positive direction of the Y axis, the drawing direction) of the sheet. That is, in the wind section 113, both of the directions in which the respective first and second root sections 117 and 118 extend are rotated by 360 degrees so as to surround the feed section 114. In the present arrangement example, since the wind section 113 is arranged so as to surround the feed section 114, the antenna element 101 can realize a radiant gain of 4 dBi or greater.

The first antenna section 111 of the antenna element 101 is connected with the first root section 117 and has a meander shape made up of at least one return pattern. A return direction (i.e., the X axis direction in FIG. 3) of the at least one return pattern in the meander shape is perpendicular to the direction in which the first root section 117 is drawn out from the wind section 113. Note that the meander shape means a meander shape obtained by alternating linear part and bending part, and the return direction means a direction in which the linear part extends.

The second antenna section 112 of the antenna element 101 has a linear shape. A direction in which the second antenna section 112 extends (i.e., the Y axis direction in FIG. 3) is parallel with a direction in which the second root section 118 is drawn out from the wind section 113.

That is, according to the antenna element 101, the return direction of the meander shape of the first antenna section 111 is perpendicular to a direction in which the linear shape of the second antenna section 112 extends.

According to the wind section 113, (i) the feed line 121 is provided above the wind section 113 and (ii) the first root section 117 has a line width wider in an area, where the feed line 121 and the first root section 117 that is provided below the feed line 121 overlap each other, than in another area where they do not overlap each other.

This can realize impedance matching in the feed section 114. Note that such a wider line width pattern is hereinafter referred to as an inductance matching pattern (i.e., wider width part) 116.

The reason why the wider line width pattern of the first root section 117 is thus referred to as the inductance matching pattern (i.e., wider width part) 116 is that the wider line width pattern of the first root section 117 serves as an inductor having an inductive reactance with respect to a high-frequency current supplied to the antenna device 100, so as to cause a change in input impedance of the antenna device 100. Note, however, that a contribution of the wider line width pattern to the input impedance is not limited only to a contribution caused by inductance. That is, it is also possible to change the input impedance of the antenna device 101 by causing a wider line width pattern of the first root section 117 to serve as a capacitor having a capacitive reactance.

The provision of the inductance matching pattern 116 causes a decrease in VSWR values of the antenna element 101. This allows expansion of a usable band in which the VSWR values are not greater than a rated value. As such, it is possible to realize a usable band including low and high frequency bands, even in a case of transmitting or receiving radio wave on a low frequency band side or radio wave on a high frequency band side. An arrangement of the inductance matching pattern 116 is later described in detail with reference to FIG. 4.

Figure 4:
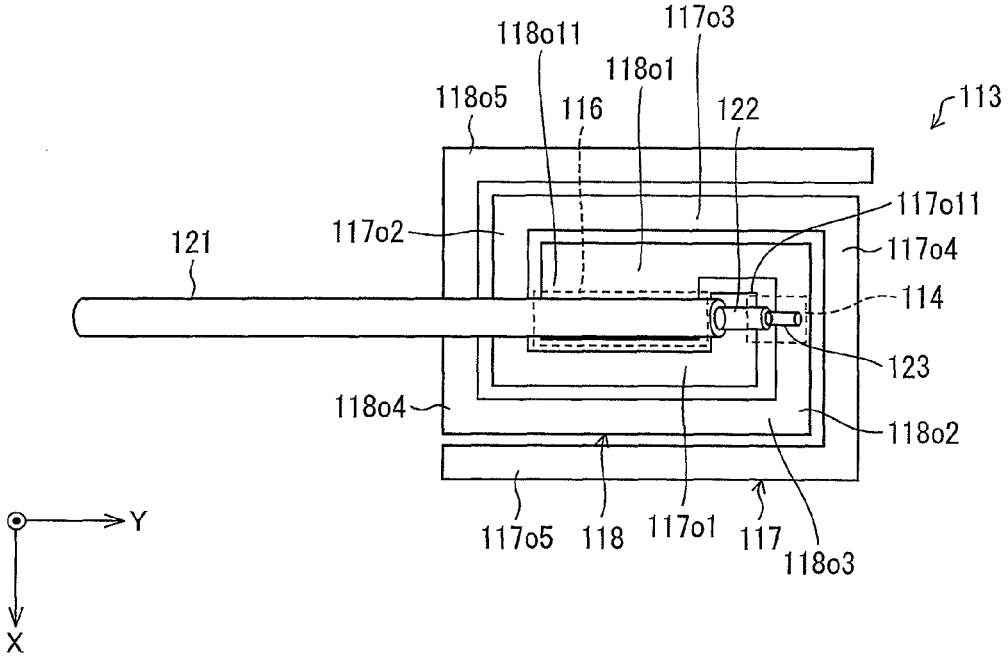
FIG. 4 is a view showing, in an enlarged size, a vicinity of a feed section in the planar antenna shown in FIG. 3.

With reference to FIG. 4, the following description will discuss the wind section 113 in more detail.

As described earlier, the wind section 113 is made up of the first root section 117 and the second root section 118 of the antenna element 101.

The first root section 117 of the antenna element 101 includes first through third linear parts. The first linear part extends, from the one end part of the antenna element 101, in a leftward direction of a sheet on which FIG. 4 is illustrated (i.e., in the negative direction of the Y axis). The second linear part is connected with the first linear part via a first bending part extending in an upward direction of the sheet (i.e., in the negative direction of the X axis) and extends, from the first bending part, in a rightward direction of the sheet (i.e., in the positive direction of the Y axis). The third linear part is connected with the second linear part via a second bending part extending in a downward direction of the sheet (i.e., in the positive direction of the X axis) and extends, from the second bending part, in a leftward direction of the sheet (i.e., in the negative direction of the Y axis).

This arrangement can also be described as follows. The first root section 117 of the first antenna element 101 has first through third linear parts **117*o*1, 117*o*3, and 117*o*5 and first and second bending parts 117*o*2 and 117*o*4. The first linear part 117*o*1 extends, in the leftward direction of the sheet on which FIG. 4 is illustrated (i.e., the negative direction of the Y axis), from the one end part of the antenna element 101. The first bending part 117*o*2 extends in the upward direction of the sheet (i.e., the negative direction of the X axis) from an end part of the first linear part 117*o*1. The second linear part 117*o*3 extends in the rightward direction of the sheet (i.e., the positive direction of the Y axis) from an end part of the first bending part 117*o*2. The second bending part 117*o*4 extends in the downward direction of the sheet (i.e., the positive direction of the X axis) from an end part of the second linear part 117*o*3. The third linear part (i.e., tail end linear section) 117*o*5 extends in the leftward direction of the sheet (i.e., the negative direction of the Y axis) from an end part of the second bending part 117*o*4**.

That is, the first root section 117 of the antenna element 101 is provided in a rectangular spiral shape so that the first through third linear parts **117*o*1, 117*o*3, and 117*o*5, which are connected with each other in this order via the first and second bending parts 117*o*2 and 117*o*4**, are arranged in parallel with each other.

On the other hand, the second root section 118 of the antenna element 101 includes fourth through sixth linear parts. The fourth linear part extends, in the rightward direction of the sheet on which FIG. 4 is illustrated (i.e., the positive direction of the Y axis), from the other end of the antenna element 101. The fifth linear part is connected with the fourth linear part via a third bending part extending in the downward direction of the sheet (i.e., the positive direction of the X axis) and extends in the leftward direction of the sheet (i.e., the negative direction of the Y axis) from the third bending part. The sixth linear section is connected with the fifth linear section via a fourth bending part extending in the upward direction of the sheet (i.e., the negative direction of the X axis) and extends in the rightward direction of the sheet (i.e., the positive direction of the Y axis) from the fourth bending part.

This arrangement can also be described as follows. The second root section 118 of the first antenna element 101 has fourth through sixth linear parts **118*o*1, 118*o*3, and 118*o*5 and third and fourth bending parts 118*o*2 and 118*o*4. The fourth linear part 118*o*1 extends, in the rightward direction of the sheet on which FIG. 4 is illustrated (i.e., the positive direction of the Y axis), from the other end of the antenna element 101. The third bending part 118*o*2 extends in the downward direction of the sheet (i.e., the positive direction of the X axis) from an end part of the fourth linear part 118*o*1. The fifth linear part 118*o*3 extends in the leftward direction of the sheet (i.e., the negative direction of the Y axis) from an end part of the third bending part 118*o*2. The fourth bending part 118*o*4 extends in the upward direction of the sheet (i.e., the negative direction of the X axis) from an end part of the fifth linear part 118*o*3. The sixth linear part (i.e., tail end linear section) 118*o*5 extends in the rightward direction of the sheet (i.e., the positive direction of the Y axis) from an end part of the fourth bending part 118*o*4**.

That is, the second root section 118 of the antenna element 101 is similarly provided in a rectangular spiral shape so that the fourth through sixth linear parts **118*o*1, 118*o*3, and 118*o*5, which are connected with each other in this order via the third and fourth bending parts 118*o*2 and 118*o*4**, are arranged in parallel with each other.

Such arrangements can be said that the first and second root sections 117 and 118 of the antenna element 101 wind each other. On this account, the reference numeral 113 is referred to as a wind section.

The first linear part 117*o*1 of the first root section 117 has a protrusion part 117*o*11 that is located at an end part of the first linear part 117*o*1 and protrudes in a width direction of the first linear part 117*o*1 toward the fourth linear part 118*o*1 of the second root section 118. Similarly, the fourth linear part 118*o*1 of the second root section 118 has a protrusion part 118*o*11 that is located at an end of the fourth linear part 118*o*1 and protrudes in a width direction of the fourth linear part 118*o*1 toward the first linear part 117*o*1 of the first root section 117.

As such, the protrusion parts 117*o*11 and 118*o*11 are provided so as to be adjacent to each other in a Y direction shown in FIG. 4 and their end parts extend in respective opposite directions of an X direction shown in FIG. 4. Further, the first and second root sections 117 and 118 are provided in the respective rectangular spiral shapes whose start parts are the respective protrusion parts 117*o*11 and 118*o*11, i.e., whose centers are the respective protrusion parts 117*o*11 and 118*o*11.

The first root section 117 of the antenna element 101 receives power via the feed section 114 that is provided in an end part of the first root section 117. On the other hand, the second root section 118 of the antenna element 101 receives power via the feed section 114 that is provided not in an end part of the second root section 118 but in a middle part of the third bending part 118*o*2 of the second root section 118.

Specifically, the feed section 114 is provided (i) in the protrusion part 117*o*11 of the first linear part 117*o*1 of the first root section 117 and (ii) in the middle part of the third bending part 118*o*2 of the second root section 118 which middle part is adjacent to the protrusion part 117*o*11 in the Y direction. Such arrangement of the feed section 114 allows the feed line 121 to (i) extend in a crosswise direction of the sheet on which FIG. 4 is illustrated and to (ii) be connected with the feed section 114, i.e., to be connected with the first and second root sections 117 and 118.

When the feed line 121 is connected with the feed section 114, outer and inner electric conductors 122 and 123 of a coaxial cable serving as the feed line 121 are connected with the first and second root sections 117 and 118 of the antenna element 101 (i.e., the first protrusion part 117*o*11 of the first linear section 117*o*1 and the middle part of the third bending part 118*o*2), respectively. There is provided, above the protrusion part 118*o*11 of the fourth linear part 118*o*1, a sheathed part of the coaxial cable serving as the feed line 121. The sheathed part (i) is sheathed in an insulating jacket (i.e., a part where the outer electric conductor 122 is not exposed) and (ii) is adjacent to a part where the outer electric conductor 122 is exposed.

The power is fed in the feed section 114 via the feed line 121 as follows. Specifically, (i) a signal, having a frequency which falls within a predetermined frequency band, is applied to the second root section 118 of the antenna element 101 via the inner electric conductor 123 of the coaxial cable serving as the feed line 121, and (ii) the earth electric potential is applied to the first root section 117 of the antenna element 101 via the outer electric conductor 122 of the coaxial cable.

In a case where the power is thus supplied between the first and second root sections 117 and 118 of the antenna element 101 in the feed section 114, it is necessary to carry out the impedance matching between feed line 121 and the feed section 114 so as to set a VSWR characteristic to a sufficiently good value.

In view of such a circumstance, the fourth linear part 118*o*1 of the second root section 118 of the antenna element 101 has the protrusion part 118*o*11 that (i) is located at the end part of the fourth linear part 118*o*1 and (ii) protrudes in the width direction of the fourth linear part 118*o*1 (in a lengthwise direction of the sheet on which FIG. 4 is illustrated, i.e., the X direction). The protrusion part 118*o*11 realizes the inductance matching pattern 116 early described. The inductance matching pattern 116 serves as an inductor for the impedance matching. That is, the protrusion part 118*o*11 is provided in the linear part 118*o*1 of the second root section 118, and the feed line 121 is provided above the protrusion part 118*o*11. The fourth linear part 118*o*1 has the line width that is wider in the area, where (i) the feed line 121 and the fourth linear part 118*o*1 that is provided below the feed line 121 overlap each other and (ii) the protrusion part 118*o*11 is provided, than in the area where the feed line 121 and the fourth linear section 118*o*1 do not overlap each other. Such a wider line width part of the fourth linear section 118*o*1 serves as the wider width section. Note that it is necessary that the wider width section have a line width wider than that of a narrowest part of the middle part of the antenna element 101. Note also that it is preferable that the line width of the wider width section is at least 1.2 times as wide as a diameter of the feed line 121, but is not greater than 4.5 times as wide as the diameter of the feed line 121.

The first and second root sections 117 and 118 of the antenna element 101 are thus drawn out in the respective opposite directions, surround the feed section 114, and are connected with the first and second antenna sections 111 and 112 shown in FIG. 3, respectively.

With such an arrangement, the first and second root sections 117 and 118 of the antenna element 101 can be provided within a relatively small rectangular region. On this account, the arrangement contributes to compactness of a region in the vicinity of the feed section 114.

Note that modified examples corresponding to the constituents are, in some cases, shown in other drawings with reference to which descriptions are made below. The modified examples are given reference signs (reference numerals) which are obtained by adding alphabetical letters such as "a", "b", "c", and so on to the reference signs given to the corresponding constituents. This concurrently clarifies relationships between the modified examples and the corresponding constituents and suggests that the modified examples are derived from the corresponding constituents.

Arrangement Example 2

Figure 5:
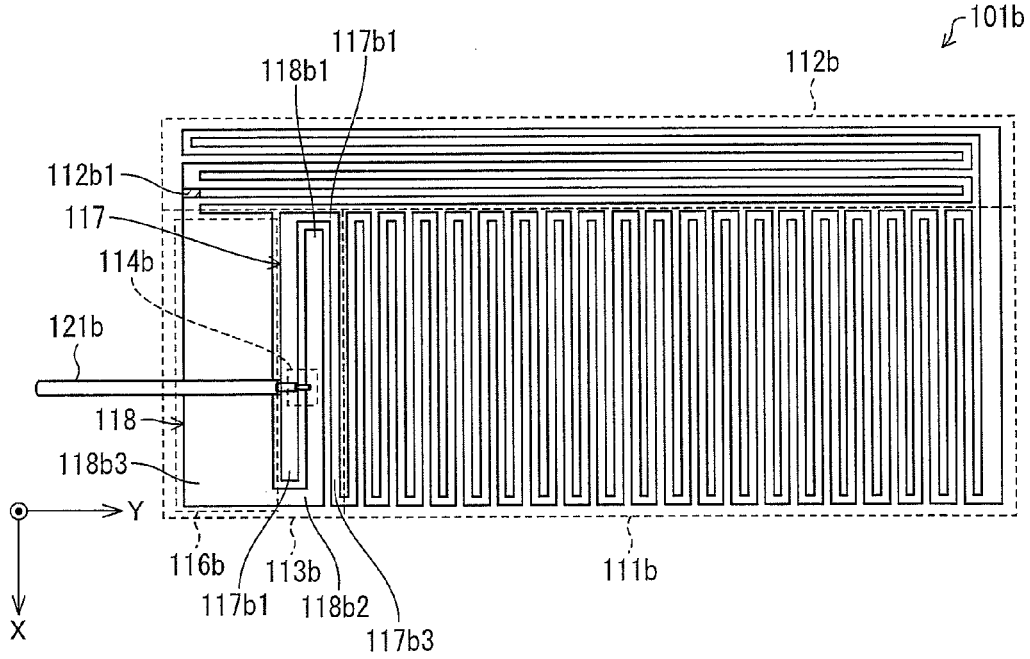
FIG. 5 is a plan view showing a second arrangement example of the planar antenna included in each of the antenna devices shown in respective FIGS. 1 and 2.

FIG. 5 is a plan view showing a second arrangement example of an antenna element. As shown in FIG. 5, an antenna element 101*b* is provided in a loop manner and has an electrically conductive path, which continues from one end part to the other end part of the antenna element 101*b*. In the present example, the antenna element 101*b* is thus provided in a loop manner. This allows the antenna element 101*b* to have a higher radiant gain, as compared with a case where the antenna element 101*b* is not provided in a loop manner.

According to the antenna element 101*b*, a wind section 113*b* is made up of a first root section 117*b* including the one end part of the antenna element 101*b* and a second root section 118*b* including the other end part of the antenna element 101*b* (see FIG. 5). Further, an intermediate section between the first and second root sections 117*b* and 118*b* constitutes a first antenna section 111*b* and a second antenna section 112*b*.

A feed section 114*b* is provided in the first and second root sections 117*b* and 118*b* of the antenna element 101*b*. The feed section 114*b* is connected with a feed line 121*b*. The antenna element 101*b* receives power via the feed line 121*b*.

The first root section 117*b* of the antenna element 101*b* is made up of a first linear part 117*b*1, a bending part 117*b*2, and a second linear part 117*b*3. The first linear part 117*b*1 extends, from the one end part of the antenna element 101*b*, in an upward direction of a sheet on which FIG. 5 is illustrated (i.e., a negative direction of an X axis). The bending part 117*b*2 extends in a rightward direction of the sheet (i.e., a positive direction of a Y axis) from an end part of the first linear part 117*b*1. The second linear part 117*b*3 extends in a downward direction of the sheet (i.e., a positive direction of the X axis) from an end part of the bending part 117*b*2. A feed point, to which one of a pair of electric conductors constituting the feed line 121*b* (i.e., an outer electric conductor in the example shown in FIG. 5) is connected, is provided in a middle part of the first linear part 117*b*1.

On the other hand, the second root section 118*b* of the antenna element 101*b* is made up of a third linear part 118*b*1, a bending part 118*b*2, and a fourth linear part 118*b*3. The third linear part 118*b*1 extends, in the downward direction of the sheet on which FIG. 5 is illustrated (i.e., the positive direction of the X axis), from the other end part of the antenna element 101*b*. The bending part 118*b*2 extends in the leftward direction of the sheet (i.e., a negative direction of the axis Y) from an end part of the third linear part 118*b*1, and the fourth linear part 118*b*3 extends in the upward direction of the sheet (i.e., the negative direction of the X axis) from an end part of the bending part 118*b*2. A feed point, to which the other one of the pair of electric conductors constituting the feed line 121*b* (i.e., an inner electric conductor in the example shown in FIG. 5) is connected, is provided in a middle part of the third linear part 118*b*1.

The wind section 113*b* is realized by combining the first and second root sections 117*b* and 118*b*, which are thus provided in respective ancyroid manners, so that (i) the first linear part 117*b*1 is located between the third and fourth linear parts 118*b*1 and 118*b*3 and (ii) the third liner part 118*b*1 is located between the first and second linear parts 117*b*1 and 117*b*3. That is, according to the wind section 113*b*, directions in which the respective first and second root sections 117*b* and 118*b* extend are rotated by 180 degrees so as to surround the feed section 114*b*. With such an arrangement, a higher radiant gain is achieved as compared with a case where no wind structure is provided.

According to the wind section 113*b*, a direction in which the first root section 117*b* of the antenna element 101*b* is drawn out is the downward direction of the sheet on which FIG. 5 is illustrated (i.e., the positive direction of the X axis), and a direction in which the second root section 118*b* of the antenna element 101*b* is drawn out is the upward direction of the sheet (i.e., the negative direction of the X axis). That is, the directions in which the respective first and second root sections 117*b* and 118*b* are drawn out are opposite to each other. In other words, the first and second root sections 117*b* and 118*b* of the antenna element 101*b* are drawn out in the respective opposite directions from the wind section 113*b*. Note that the directions in which the respective first and second root sections 117*b* and 118*b* are drawn out from the wind section 113*b* are perpendicular to a direction in which the feed line 121*b* extends (i.e., a Y axis direction).

According to the antenna element 101*b*, the first antenna section 111*b* is constituted by that part of the intermediate section which follows an end part of the first root section 117*b* drawn out from the wind section 113*b* (i.e., an end part of the second linear part 117*b*3 which end part is closer to a bottom of the sheet on which FIG. 5 is illustrated). The first antenna section 111*b* has a meander shape made up of at least one return pattern. A return direction of the at least one return pattern of the meander shape is parallel to the direction in which the first root section 117*b* of the antenna element 101*b* is drawn out from the wind section 113*b*.

Also, according to the antenna element 101*b*, the second antenna section 112*b* is constituted by that part of the intermediate section which follows an end part of the second root section 118*b* drawn out from the wind section 113*b* (i.e., an end part of the fourth linear part 118*b*3 which end part is closer to a top of the sheet on which FIG. 5 is illustrated). Like the first antenna section 111*b*, the second antenna section 112*b* has a meander shape made up of at least one return pattern. A return direction of the at last one return pattern of the meander shape is perpendicular to the direction in which the second root section 117*b* of the antenna element 101*b* is drawn out from the wind section 113*b*. Note that, according to the second antenna section 112*b* shown in FIG. 5, the electrically conductive paths each thus having the meander shape are short-circuited by a short-circuit section 112*b*1 so as to cause decreases in VSWR values in an operating band.

According to the antenna element 101*b*, (i) the feed line 121*b* is provided above the wind section 113*b* and (ii) the second root section 118*b* of the antenna element 101*b* has a line width that is wider in an area (i.e., the fourth linear part 118*b*3), where the feed line 121*b* and the second root section 118*b* that is provided below the feed line 121*b* overlap each other, than in an area where they do not overlap each other (see FIG. 5). Such a wider line width part of the second root section 118*b* serves as an inductance matching pattern 116*b*. As such, it is possible to make the impedance matching in the feed section 114*b*.

Arrangement Example 3

Figure 6:
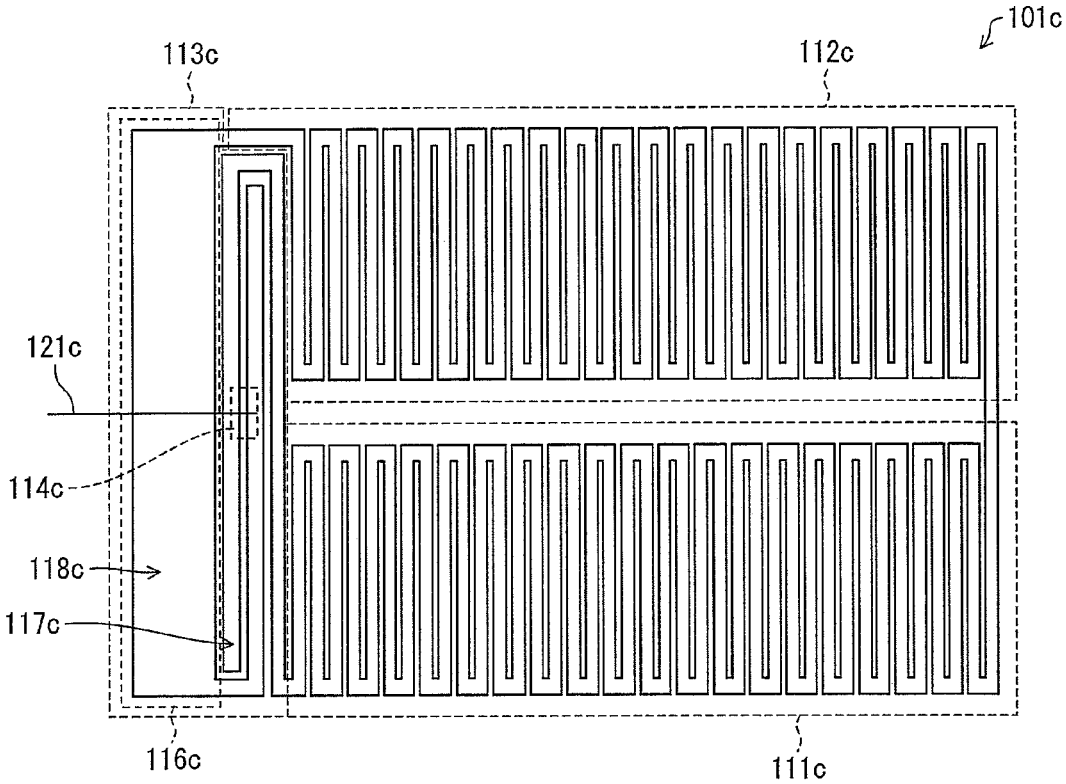
FIG. 6 is a plan view showing a third arrangement example of the planar antenna included in each of the antenna devices shown in respective FIGS. 1 and 2.

FIG. 6 is a plan view showing a third arrangement example of an antenna element. As shown in FIG. 6, an antenna element 101*c* is provided in a loop manner and has an electrically conductive path that continues from one end part to the other end part of the antenna element 101*c*. In the present arrangement example, the antenna element 101*c* is thus provided in the loop manner. This allows the antenna element 101*c* to have a higher radiant gain, as compared with a case where the antenna element 101*c* is not provided in a loop manner.

According to the antenna element 101*c*, a wind section 113*c* is constituted by first and second root sections 117*c* and 118*c* including one end part and the other end part of the antenna element 101*c*, respectively (see FIG. 6). Further, an intermediate section between the first and second root sections 117*c* and 118*c* constitutes a first antenna section 111*c* and a second antenna section 112*c*.

A feed section 114*c* is provided in the first and second root sections 117*c* and 118*c* of the antenna element 101*c*. The feed section 114*c* is connected with a feed line 121*c*. The antenna element 101*c* receives power via the feed line 121*c*.

The first and second root sections 117*c* and 118*c* of the antenna element 101*c* have shapes similar to the respective first and second root sections 117*b* and 118*b* of the antenna element 101*b* in the second arrangement example. Also, how the first and second root sections 117*c* and 118*c* of the antenna element 101*c* are combined is similar to how the first and second root sections 117*b* and 118*b* of the antenna element 101*b* are combined in the second arrangement example. That is, according to the wind section 113*c*, directions in which the respective first and second root sections 117*c* and 118*c* extend are rotated by 180 degrees so as to surround the feed section 114*c*, similarly to the second arrangement example. This causes a higher radiant gain to be achieved, as compared with a case where no wind structure is provided.

According to the antenna element 101*c*, the first antenna section 111*c* is constituted by that part of the intermediate section which follows the first root section 117*c* drawn out from the wind section 113*c*. The first antenna section 111*c* has a meander shape made up of at least one return pattern. According to the first antenna section 111*c*, a return direction of the at least one return pattern of the meander shape is parallel to a direction in which the first root section 117*c* of the antenna element 101*c* is drawn out from the wind section 113*c*.

Also, according to the antenna element 101*c*, the second antenna section 112*c* is constituted by that part of the intermediate section which follows the second root section 118*c* drawn out from the wind section 113*c*. According to the second antenna section 112, a return direction of a return pattern of a meander shape is parallel to a direction in which the second root section 118*c* of the antenna element 101*c* is drawn out from the wind section 113*c*.

That is, according to the antenna element 101*c*, the first and second antenna sections 111*c* and 112*c* having the respective meander shapes are arranged (i) so as to be away from each other, (ii) so as to be juxtaposed to each other, and (iii) so that the return direction of the meander shape of the first antenna section 111*c* becomes parallel to the return direction of the meander shape of the second antenna section 112*c*. With such an arrangement, a radiant gain can be improved.

According to the antenna element 101*c*, (i) the feed line 121*c* is provided above the wind section 113*c* and (ii) the second root section 118*c* of the antenna element 101*c* has a line width that is wider in an area, where the feed line 121*c* and the second root section 118*c* that is provided below the feed line 121*c* overlap each other, than in an area where they do not overlap each other (see FIG. 6). Such a wider line width part of the second root section 118*c* serves as an inductance matching pattern 116*c*. As such, it is possible to make the impedance matching in the feed section 114*c*.

Arrangement Example 4

Figure 7:
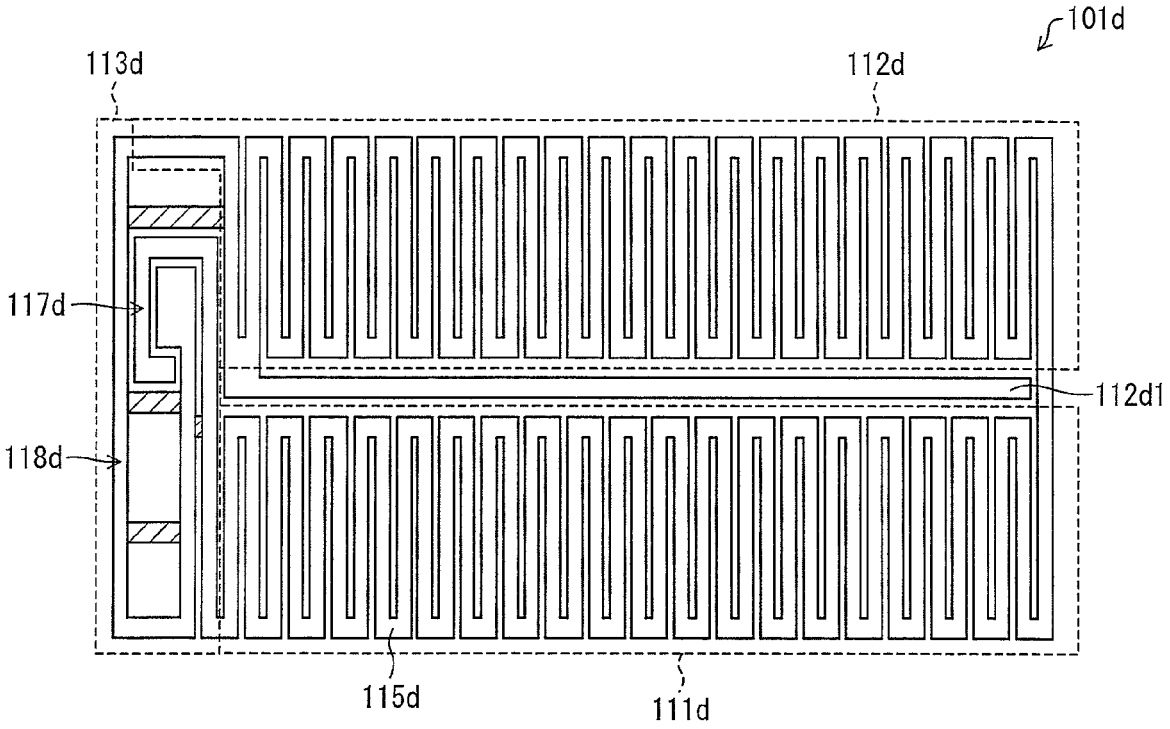
FIG. 7 is a plan view showing a fourth arrangement example of the planar antenna included in each of the antenna devices shown in respective FIGS. 1 and 2.

FIG. 7 is a plan view showing a fourth arrangement example of an antenna element. As shown in FIG. 7, an antenna element 101*d* follows the arrangement of the antenna element 101*c* shown in FIG. 6. Note, however, that the antenna element 101*d* is different from the antenna element 101*c* shown in FIG. 6 in that (1), in a wind section 113*d*, (i) first and second root sections 117*d* and 118*d* are short-circuited and (ii) two different parts of the second root section 118*d* are short-circuited and (2) a matching pattern 112*d*1, which is branched out from a second antenna section 112*d*, is further provided between a first antenna section 111*d* and the second antenna section 112*d*. In FIG. 7, short-circuited parts in the wind section 113*d* are indicated by diagonal lines.

When the first and second root sections 117*d* and 118*d* of the antenna element 101*d* are short-circuited in the wind section 113*d*, there occurs a new loop containing a short-circuited path. This causes a new resonance point to be generated, so that a VSWR characteristic is improved. Further, in a case where the impedance matching cannot be carried out in the antenna element 101*c* shown in FIG. 6, it is useful to further provide a matching pattern (see the matching pattern 112*d*1 shown in FIG. 7) between the first and second antenna sections 111*d* and 112*d*.

Arrangement Example 5

Figure 8:
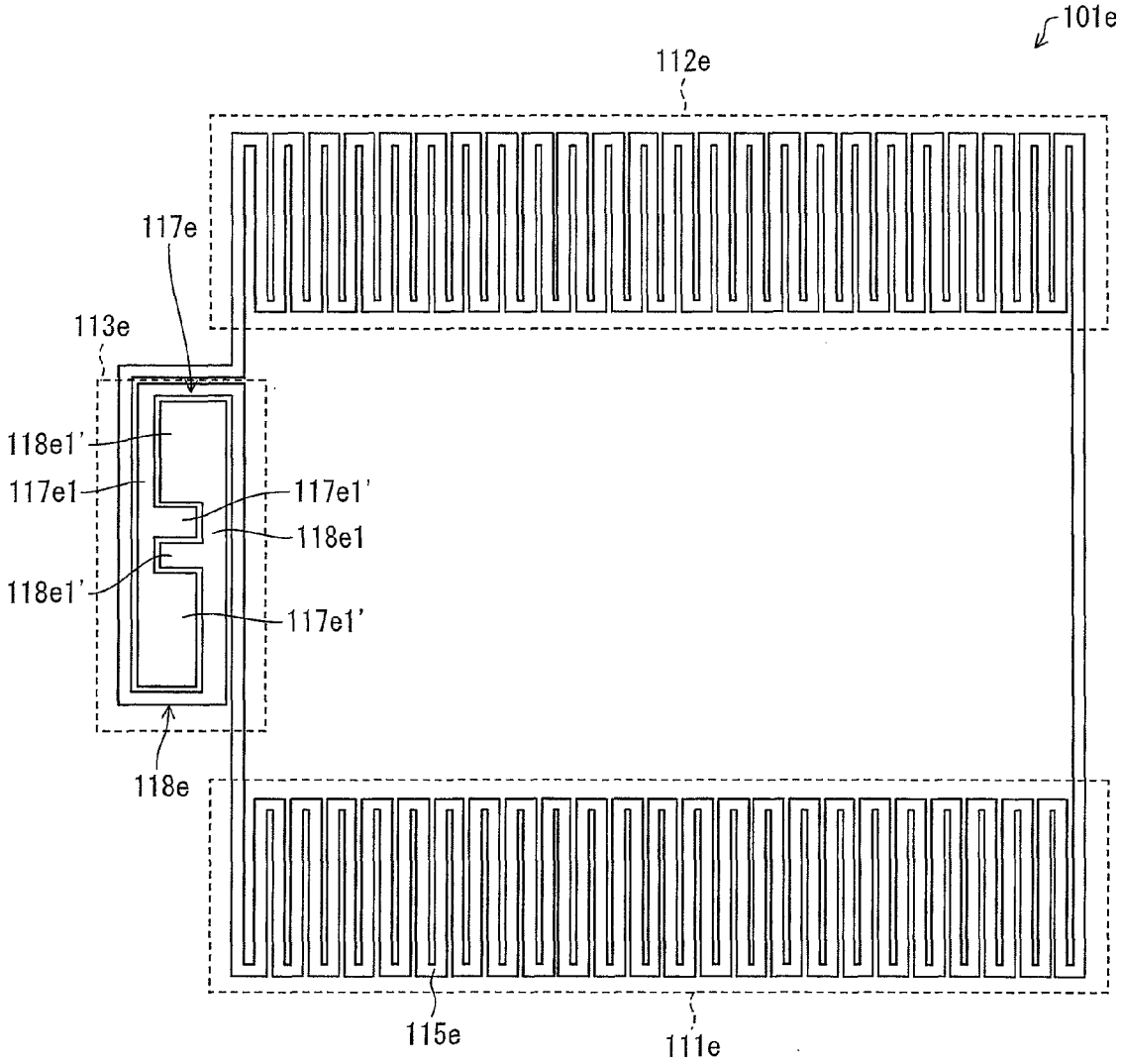
FIG. 8 is a plan view showing a fifth arrangement example of the planar antenna included in each of the antenna devices shown in respective FIGS. 1 and 2.

FIG. 8 is a plan view showing a fifth arrangement example of an antenna element. As shown in FIG. 8, an antenna element 101*e* follows the arrangement of the antenna element 101*c* shown in FIG. 6. Note, however, that the antenna element 101*e* is different from the antenna element 101*c* shown in FIG. 6 in that wider spacing between first and second antenna sections 111*e* and 112*e* is secured. In this Arrangement Example, the spacing between the first and second antenna elements 111*e* and 112*e* is set to be greater than a length of a first linear section 117*e*1 of a first root section 117*e*.

It becomes possible to increase a radiant gain by approximately 4 dB, by changing the spacing between the first and second antenna sections 111*c* and 112*c* so as to have wider spacing equal to the spacing between the first and second antenna sections 111*e* and 112*e* shown in FIG. 8. In this case, it becomes possible to further arrange various components in such wider spacing between the first and second antenna sections 111*e* and 112*e*.

For example, in a case where the antenna element 101*e* is mounted on a mobile phone terminal, it is possible to further provide a component such as a sub display (i.e., a display, provided behind the main display, which is smaller than a main display) in the spacing between the first and second antenna sections 111*e* and 112*e*. Note that, if a size is to a degree that is approximately equal to a size of the sub display, then it is possible to sufficiently reduce a fluctuation in input impedance caused by the sub display, by widening the spacing between the first and second antenna sections 111*e* and 112*e*.

The wind section 113*e* of the antenna element 101*e* shown in FIG. 8 is different from the wind section 113*c* of the antenna element 101*c* shown in FIG. 6 in that (i) the linear part 117*e*1, including the end part of the first root section 117*e*, is configured to further have two (2) protrusion parts 117*e*1', (ii) the third linear part 118*e*1, including the end part of the second root section 118*e*, is configured to further have two (2) protrusion parts 118*e*1', and (iii) the protrusion parts 117*e*1' and 118*e*1' are combined so as to engage with each other. With such an arrangement, it becomes easier to supply power via a feed line provided so as to extend in a direction in which the first and third linear parts 117*e*1 and 118*e*1 extend.

Embodiment 3

Figure 9:
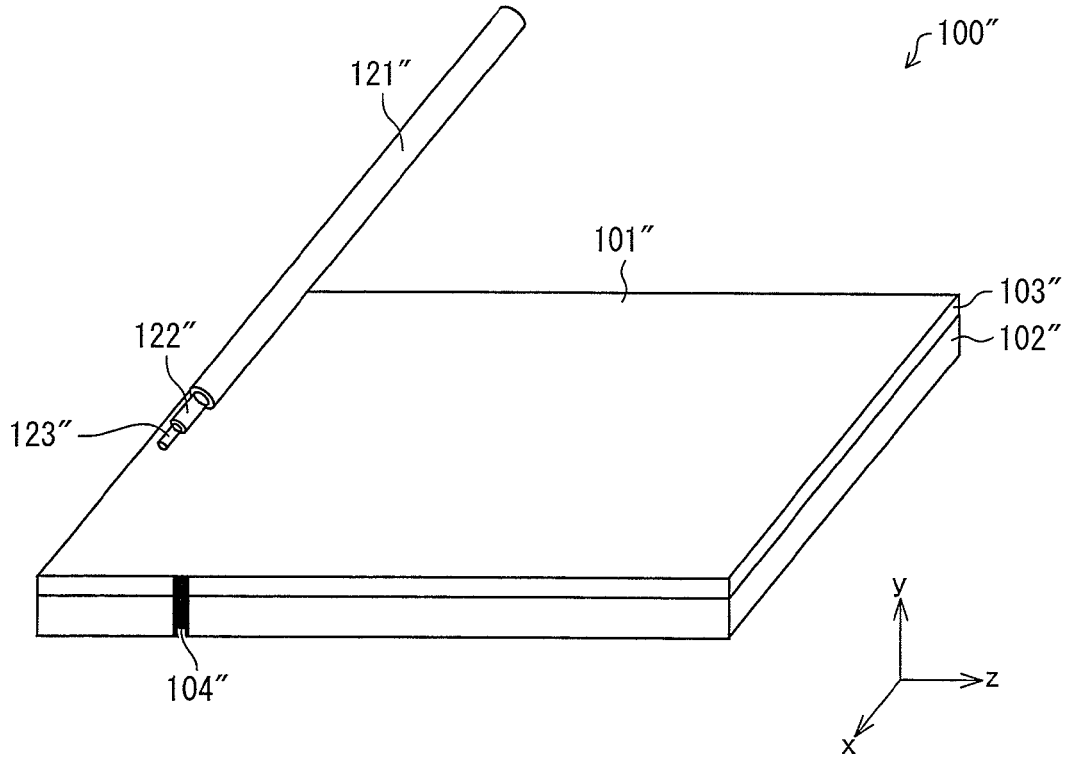
FIG. 9 is a perspective view showing how an antenna device is arranged in accordance with a third embodiment of the present invention.

With reference to FIG. 9, the following description will discuss how an antenna device 100" is arranged in accordance with Embodiment 3. FIG. 9 is a perspective view illustrating the antenna device 100".

As shown in FIG. 9, the antenna device 100" follows the antenna device 100 of Embodiment 1 and has an arrangement in which a part of an antenna element 101" is bent so as to be connected with an electric conductor plate 102" and so as to serve as a short-circuit section 104". Note that a dielectric sheet 103" is sandwiched between the antenna element 101" and the electric conductor plate 102" (see FIG. 9). Note, however, that there is no direct electric connection between opposed surfaces of respective of the antenna element 101" and the electric conductor plate 102".

Further, a pair of electric conductors, of which the feed line 121" is made up, are connected with an antenna element constituting the antenna element 101". Specifically, as shown in FIG. 9, outer and inner electric conductors 122" and 123" of a coaxial cable serving as the feed line 121" are connected with the antenna element constituting the antenna element 101".

Therefore, the electric conductor plate 102" also has the function of the antenna element 101". That is, like the antenna device 100 of Embodiment 1, (i) the electric conductor plate 102" and (ii) the antenna element constituting the antenna element 101" work together to serve as one (1) antenna element in response to a high-frequency current supplied via the feed line 121". As such, it is possible to obtain a radiant gain higher than that of the radiant element 101" alone.

Further, (i) a top surface of the antenna element 101" (i.e., a surface of the antenna element 101" which surface is opposite to a surface that is in contact with the dielectric sheet 103") and (ii) a bottom surface of the electric conductor pate 102" (i.e., a surface of the electric conductor plate 102" which surface is opposite to a surface that is in contact with the dielectric sheet 103"), are subjected to a lamination process using an insulating film. This allows the antenna device 100" to normally function even in a case where the antenna device 100" is in contact with another metal member.

Note that it is desirable that an orthogonal projection of the electric conductor plate 102" with respect to an antenna element formation plane includes the antenna element 101". In simple terms, it is preferable that the electric conductor plate 102" covers over the antenna element 101" when the electric conductor plate 102" is viewed from a side opposite to an antenna element 101" side. Like the antenna device 100 of Embodiment 1, this allows a further increase in radiant gain and a decrease in fluctuation in input impedance of the antenna device 100" which is caused in a case where an electric conductor is provided near a rear side of the antenna device 100".

Arrangement Example of Antenna Element

The following description will discuss arrangement examples of antenna elements with reference to FIGS. 10 through 13. Note that each arrangement example described below is an antenna element suitable for both of the antenna element 101 included in the antenna device 100 of Embodiment 1 and the antenna element 101" included in the antenna device 100" of Embodiment 3.

Arrangement Example 6

Figure 10:
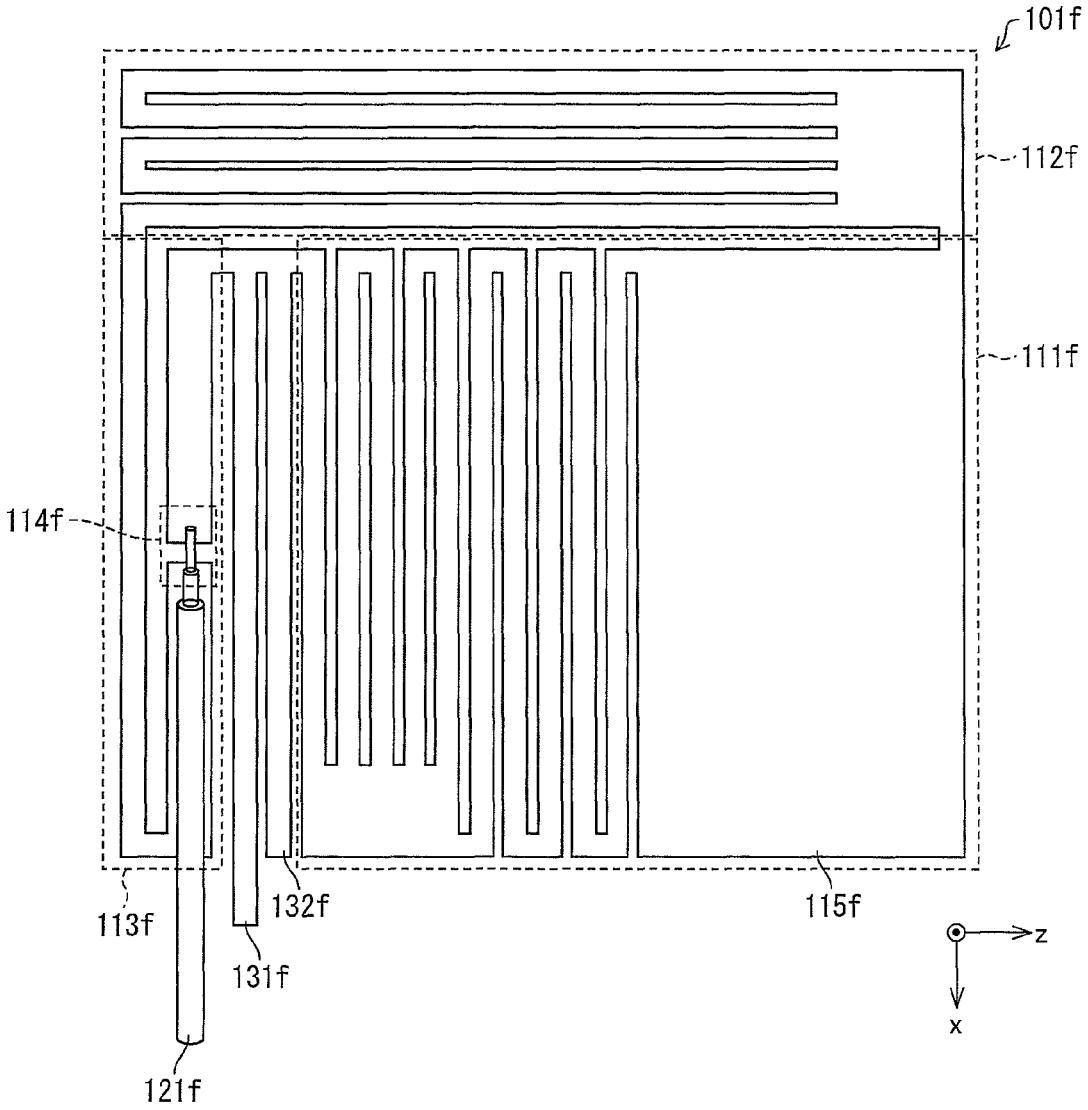
FIG. 10 is a plan view showing a sixth arrangement example of the planar antenna included in the antenna device shown in FIG. 9.

FIG. 10 is a plan view showing a sixth arrangement example of an antenna element. A basic structure of an antenna element 101*f* shown in FIG. 10 is similar to the antenna element 101*b* shown in FIG. 5. Note, however, that the antenna element 101*f* is different from the antenna element 101*b* shown in FIG. 5 in that the antenna element 101*f* includes first and second branches 131*f* and 132*f* which are provided adjacently to each other between a wind section 113*f* and a first antenna section 111*f*. According to an antenna device 100" (see FIG. 9), an end part of the first branch 131*f* serves as the short-circuit section 104" (see FIG. 9), and an end part of the second branch 132*f* mainly serves as a parasitic element.

The first branch 131*f* is thus provided, and the end part of the first branch 131*f* is thus used as the short-circuit section 104" (see FIG. 9). This makes it unnecessary to short-circuit the antenna element 101*f* and the conductor plate 102" (see FIG. 9) by use of an electric conductor independently provided. That is, it is possible to easily manufacture the antenna device 100". Further, the second branch 132*f* is thus provided next to the first branch 131*f* used as the short-circuit section 104". This makes it possible to reduce VSWR values of the antenna device 100". This is based on the following facts (i) and (ii). With the provision of the second branch 132*f*, (i) a new resonance point is caused so that the VSWR values are decreased locally near the new resonance point and (ii) impedance matching is carried out between the antenna element 101*f* and the conductor plate 102", and therefore there occurs global decreases in the VSWR values.

Figure 11:
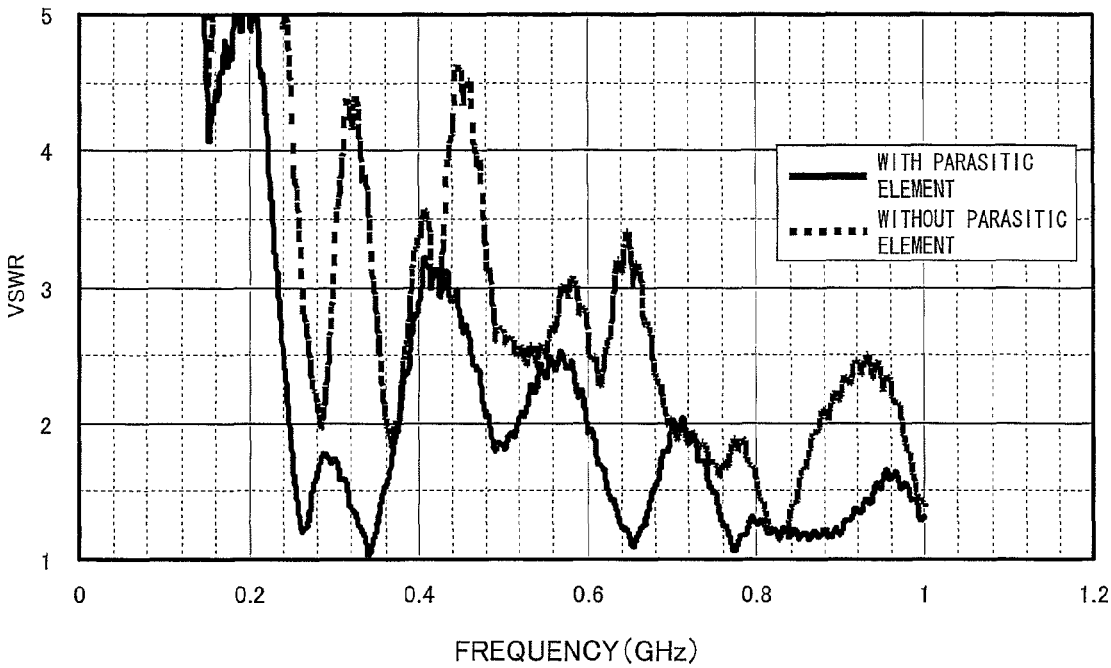
FIG. 11 shows graphs of VSWR (voltage standing wave ratio) characteristics of the antenna device (see FIG. 9) which are obtained in respective cases where a second branch is provided (i.e., in a case where a parasitic element is provided) and where no second branch is provided (i.e., in a case where no parasitic element is provided).

FIG. 11 shows graphs of VSWR characteristics of the antenna device 101" including the antenna element 101*f*, which VSWR characteristics are obtained in (i) a case where the second branch 132*f* is provided (i.e., in a case where the parasitic element is provided) and in (ii) a case where no second branch 132*f* is provided (i.e., in a case where no parasitic element is provided).

FIG. 11 clearly shows that the VSWR values are decreased locally in a band of not less than 0.8 GHz but not more than 0.9 GHz. This is because the provision of the second branch 132*f* causes an occurrence of the new resonance point in the band. Note that the VSWR values are decreased globally in an entire band shown in FIG. 11. This is because the impedance matching is carried out between the antenna element 101*f* (see FIG. 9) and the conductor plate 102" (see FIG. 9).

Note that a phenomenon that the VSWR values are locally decreased by the occurrence of the new resonance point is caused irrespectively of where the second branch 132*f* is provided. It follows that, if it is merely intended to obtain the effect of locally decreasing the VSWR, it is not necessary to provide the second branch 132*f* so as to be adjacent to the first branch 131*f*.

Arrangement Example 7

Figure 12:
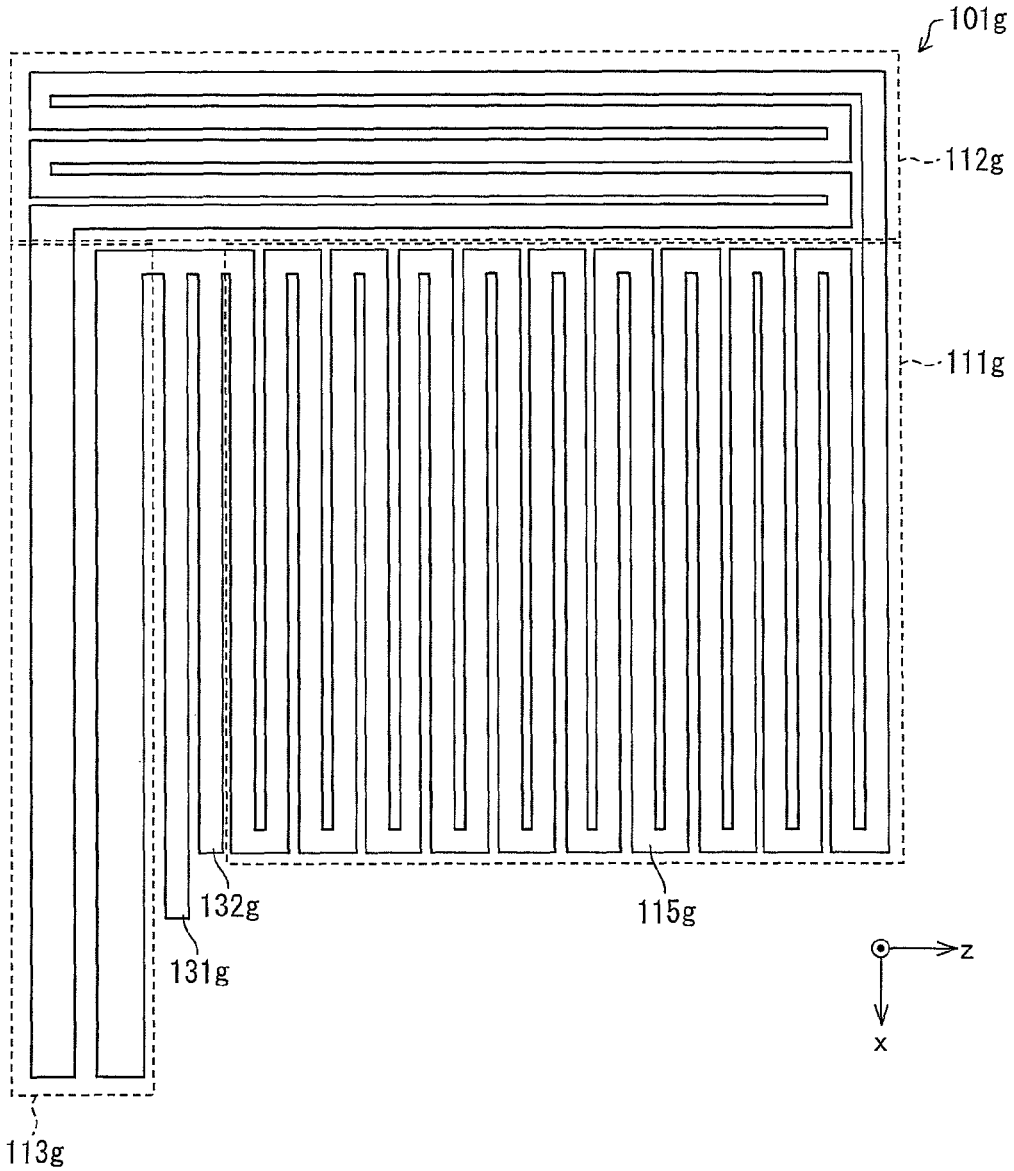
FIG. 12 is a plan view showing a seventh arrangement example of the planar antenna included in the antenna device shown in FIG. 9.

FIG. 12 is a plan view showing a seventh arrangement example of an antenna element. As shown in FIG. 12, a basic structure of an antenna element 101*g* is similar to the antenna element 101*f* shown in FIG. 10. The antenna element 101*g* is also similar to the antenna element 101*f* shown in FIG. 10 in that the antenna element 101*g* has two branches 131*g* and 132*g* provided adjacent to each other between a wind section 113*g* and a first antenna section 111*g*. Note, however, that the antenna element 101*g* is different from the antenna element 101*f* shown in FIG. 10 in that both end parts (i.e., root sections) of the antenna element 101*g* form respective microstriplines in a region 113*g* that is located near a feed point and is referred to as a "wind section" in the antenna element 101*f* shown in FIG. 10.

Figure 13:
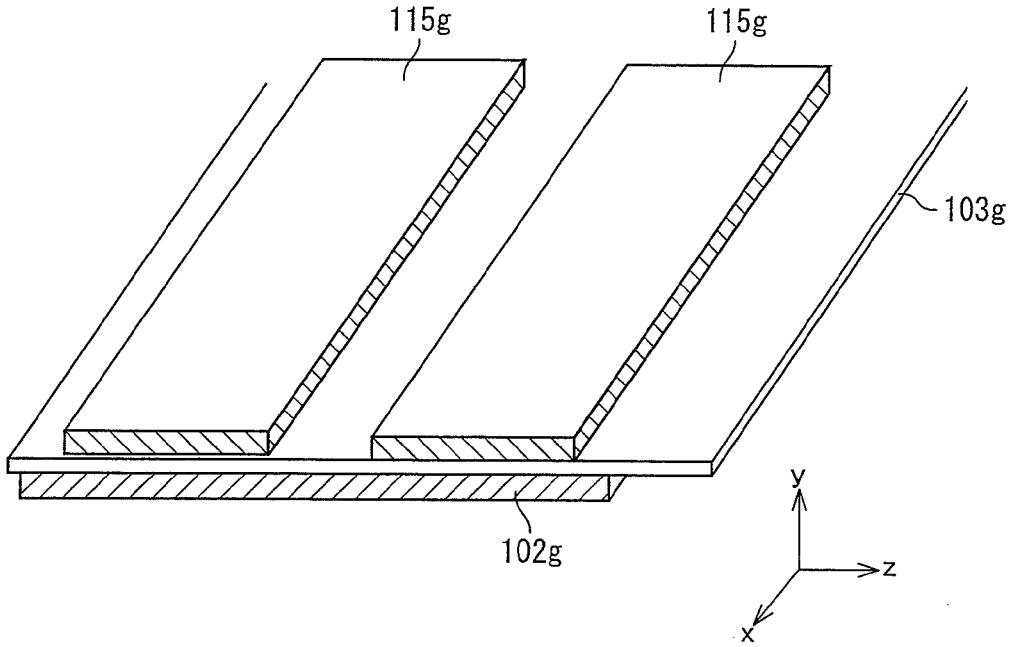
FIG. 13 is a perspective view showing how an antenna device on which the planar antenna shown in FIG. 12 is mounted is arranged, and shows a part of the antenna device in an exaggerated size.

FIG. 13 is a perspective view showing an antenna device on which the antenna element 101*g* is mounted, and shows a vicinity of the region 113*g* in the antenna element 101*g* in an exaggerated size. As shown in FIG. 13, both end parts of the antenna element 101*g* are (i) provided so as to have linear shapes and (ii) arranged on a dielectric sheet 103*g* so as to be parallel to each other. A pair made up of one end part of the antenna element 101*g* and an electric conductor plate

102*g* forms a microstripline, whereas a pair made up of the other end part of the antenna element 101*g* and the electric conductor plate 102*g* forms another microstripline. This causes a characteristic impedance of the antenna device 100' to be stabilized.

Application Example of Antenna Device 100"

With reference to FIGS. 14 through 17, the following description will discuss an example in which an antenna device 100" is applied to a mobile phone terminal, more specifically, an example in which the antenna device 100" is applied to a cycloidal mobile phone terminal. The antenna device 100" serves, in such a mobile phone terminal, as a one-segment receiving antenna or a full-segment receiving antenna.

Note that the cycloidal mobile phone terminal indicates a mobile phone terminal including a first housing, a second housing foldably attached to the first housing, and a third housing rotatably attached to the second housing. According to the cycloidal mobile phone terminal, constituents such as a telephone keypad are usually provided in the first housing, and constituents such as a liquid crystal display are provided in the third housing. Further, the second housing serves as a rotation support section that rotatably supports the third housing. The antenna device 100" is integrated with an electric conductor plate 102". It is therefore difficult for the characteristics of the antenna device 100" to be affected by a metal member provided near the antenna device 100". This allows the antenna device 100" to be built in the second housing or in the third housing. Alternatively, the antenna device 100" can be built in the first housing while it is being attached to a rechargeable planar battery, as described below.

Figure 14:
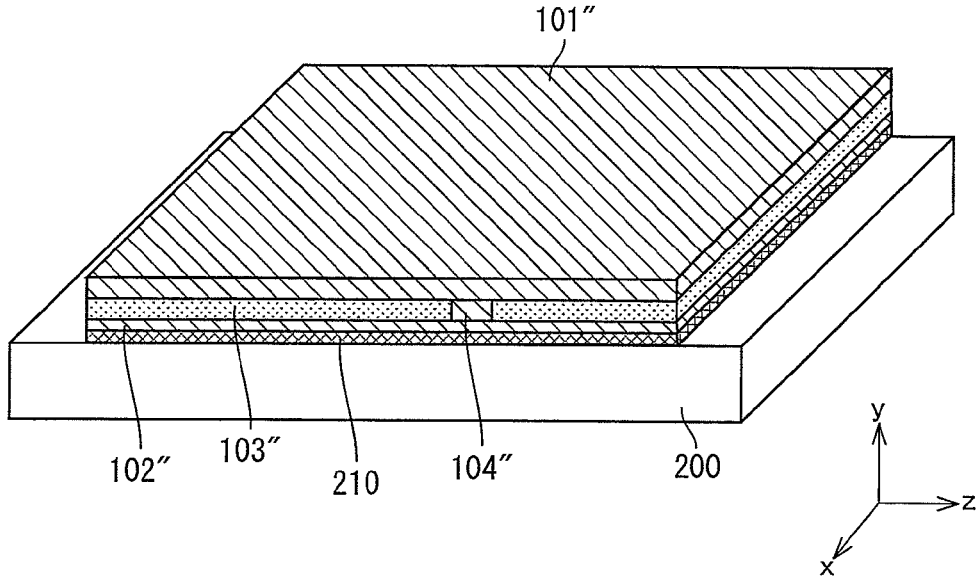
FIG. 14 is a perspective view showing the antenna device shown in FIG. 9 which is attached to a rechargeable planar battery.

FIG. 14 is a perspective view showing the antenna device 100" that is attached to a rechargeable planar battery 200. As shown in FIG. 14, the antenna device 100" is attached to the rechargeable planar battery 200 via an adhesion layer 210 provided on a rear surface of an electric conductor plate 102" (i.e., a surface of the electric conductor plate 102" which surface is opposite to a surface facing an antenna element 101" via a dielectric sheet 103"). A nickel-cadmium rechargeable battery is used as the rechargeable planar battery 200.

Figure 15:
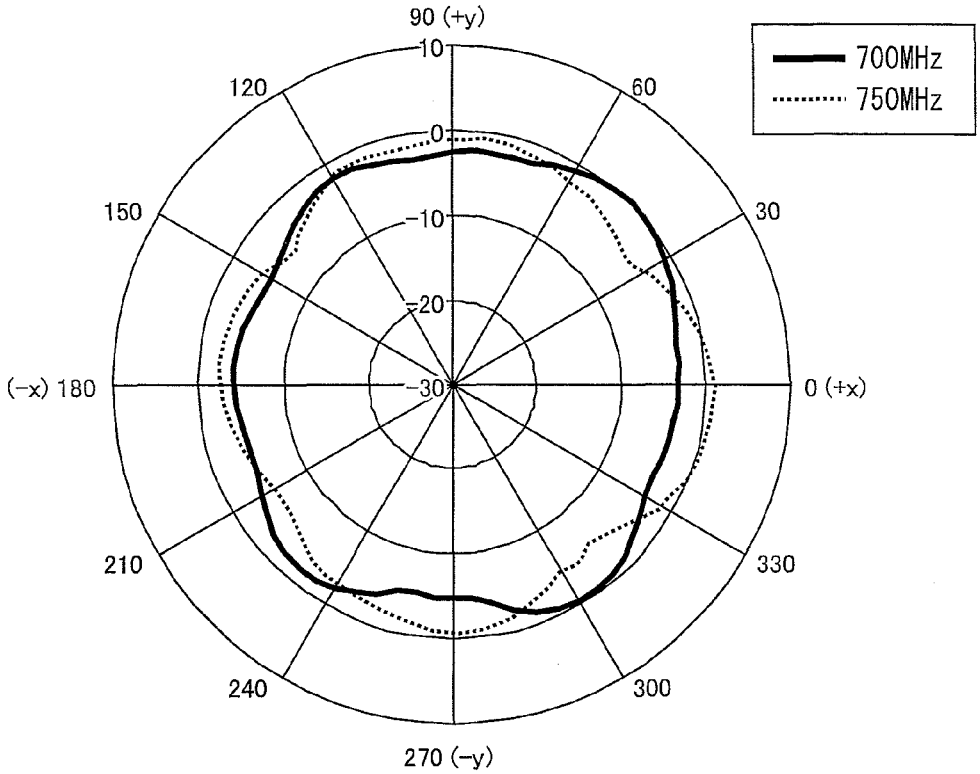
FIG. 15 shows graphs of in-xy-plane radiation directivities of the antenna device (see FIG. 14) in respective bands of 700 MHz and 750 MHz.

FIG. 15 shows graphs of in-XY-plane (i.e., a plane perpendicular to the antenna element 101") radiation directivities of the antenna device 100" attached to the rechargeable planar battery 200. The radiation directivities are obtained in respective bands of 700 MHz and 750 MHz. As shown in FIG. 15, the antenna device 100" has a substantially non-directivity radiation characteristic even in a state where it is attached to the rechargeable planar battery 200.

Figure 16:
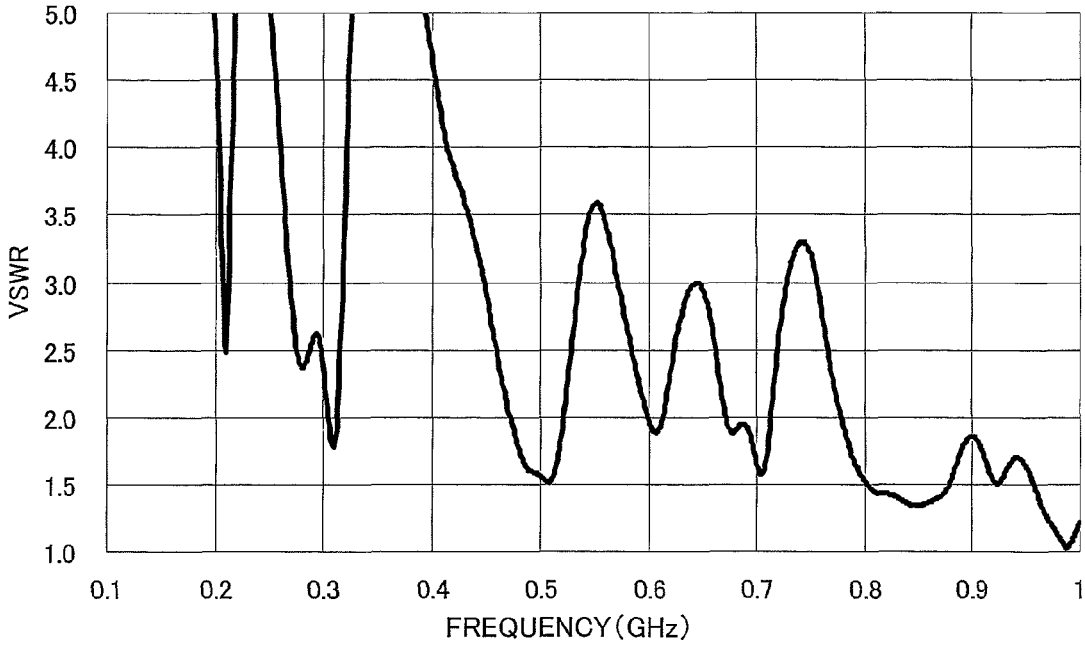
FIG. 16 is a graph of a VSWR characteristic of the antenna device shown in FIG. 14.

FIG. 16 shows a graph of a VSWR (voltage standing wave ratio) characteristic of the antenna device 100" attached to the rechargeable planar battery 200. As shown in FIG. 16, VSWR values are reduced to 3.5 or less in an operating band (470 MHz to 860 MHz).

Figure 17:
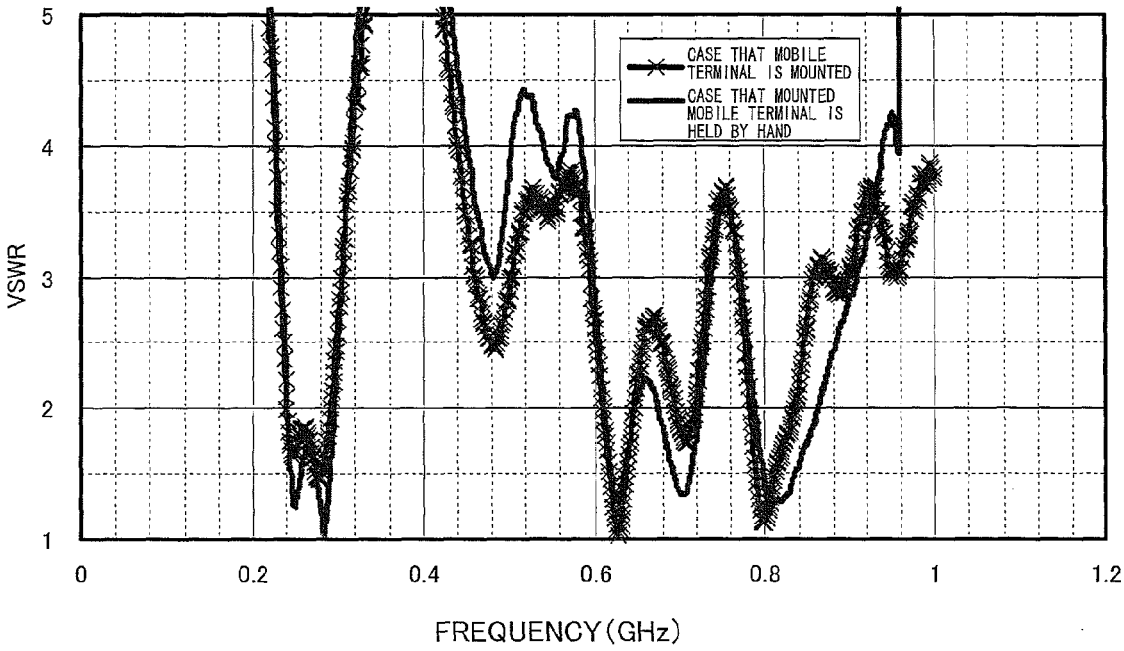
FIG. 17 is a graph of a VSWR characteristic of the antenna device (see FIG. 14) which VSWR characteristic is measured in a state that the antenna device (see FIG. 14) is built in a mobile phone terminal.

FIG. 17 shows a graph of a VSWR characteristic of the antenna device 100" that is (i) attached to the rechargeable planar battery 200 and (ii) built in the cycloidal mobile phone terminal. A solid line with "x" marks indicates a result obtained by measuring the VSWR characteristic in a state where the mobile phone terminal is placed on a table, whereas a solid line with no "x" marks indicates a result obtained by measuring the VSWR characteristic in a state where the mobile phone terminal is held by a hand. As is clear from FIG. 17, VSWR values are not greatly increased even in the state where the mobile phone terminal is held by the hand. This demonstrates that a sufficient sensitivity can be obtained in actual use.

Note that a device, to which the antenna device 100" is applied, is not limited to the mobile phone terminal, even though the above description has discussed the example in which the antenna device 100" is applied to the mobile phone terminal. Because the antenna device 100" is integrated with the electric conductor plate 102" so that it is more difficult for the characteristics of the antenna device 100" to be affected by the metal member provided near the antenna device 100", the antenna device 100" can be provided in a place which has been thought as a place where it is difficult to provide an antenna in an electronic device.

In a laptop personal computer (so-called "notebook-size personal computer"), for example, the antenna device 100" can be provided behind a keyboard. According to the laptop personal computer, a metal plate is usually provided behind the keyboard. This prevents a conventional antenna device from being provided behind the keyboard. However, the antenna device 100" of the present invention can be provided behind the keyboard without a significant deterioration in its characteristic.

Further, the antenna device 100" can be used by attaching it to a vehicle body (for example, a roof section and a hood section) and a front glass (alternatively, a side glass or a rear glass) of a vehicle. Note that, in a case where the antenna device 100" is used as a vehicle antenna, it is preferable for the antenna device 100" to include a booster.

Closing

The antenna device of the present invention is thus an antenna device including: an antenna element provided in a given plane; and an electric conductor plate provided so as to face the given plane, the antenna element and the electric conductor plate being short-circuited, and the antenna element being connected with a pair of electric conductors constituting a feed line.

With the arrangement, the antenna element and the electric conductor plate are short-circuited, and the pair of conductors constituting the feed line is connected with the antenna element. In such a circumstance, the electric conductor plate also has the function of the antenna element. It is therefore possible to increase a radiant gain higher than in a case where no conductor plate is provided.

Further, the electric conductor plate is provided so as to face the antenna element. This makes it less likely that the antenna element is adversely affected even in a case where a member such as a metal member is provided on a side of the conductor plate opposite to an antenna element side. That is, the input impedance becomes more stable than in a case where no conductor plate is provided.

Further, because the electric conductor plate is provided so as to face the antenna element, it is also possible to bring about the above effect without causing a size increase as a result of providing the electric conductor plate.

It is preferable that the antenna device of the present invention is arranged so that an orthogonal projection of the electric conductor plate with respect to the given plane includes the antenna element.

With the arrangement, the electric conductor plate covers over the antenna element. This makes it less likely that the antenna element is adversely affected even in a case where a member such as a metal member is provided on a side of the electric conductor plate opposite to the antenna element side. As such, the input impedance can be further improved in stability.

It is preferable that the antenna device of the present invention is arranged so that the electric conductor plate is a metal frame that holds a liquid crystal panel.

With the arrangement, in a case of using the antenna device of the present invention in combination with a liquid crystal display, it is not necessary to separately provide the electric conductor plate. This makes it possible to realize the antenna device having a high spatial use efficiency.

It is preferable that the antenna device of the present invention is arranged so that: the antenna element has a path which continues from one end part of the antenna element to the other end part of the antenna element; and the one and the other end parts of the antenna element are connected with the respective pair of electric conductors constituting the feed line.

The arrangement can realize a high radiant gain, like a loop antenna device having a loop shape.

It is preferable that the antenna device of the present invention is arranged so that the antenna element includes two root sections that (i) surround a feed section with which the pair of conductors constituting the feed line are connected and (ii) are drawn out in respective opposite directions from the feed section.

With the arrangement, resonance modes of the antenna element are shifted to be close to each other. This decreases VSWR in a band where the resonance modes are shifted close to each other, and thereby expands a usable band.

It is preferable that the antenna device of the present invention is arranged so that the antenna element has a wider width section that is provided in at least one of the two root sections and is wider in line width in a region, where the feed line and the wider width section overlap each other, than in another region.

With the arrangement, it is possible to match the input impedance of the antenna device with an impedance of the feed line.

It is preferable that the antenna device of the present invention is arranged so that the antenna element has a first branch whose leading end part is connected with the electric conductor plate.

With the arrangement, it is possible to easily short-circuit the antenna element and the electric conductor plate without providing a new component. This can make manufacturing of the antenna device easier.

It is preferable that the antenna device of the present invention is arranged so that the antenna element has further a second branch adjacent to the first branch.

With the arrangement, it is possible to decrease VSWR values and thereby expand an operating band.

It is preferable that the antenna device of the present invention is arranged so that the one and the other end parts of the antenna element form respective microstriplines.

With the arrangement, a characteristic impedance of the antenna device can be more stabilized.

The present invention is not limited to the description of each of Embodiments 1 through 3, but may be altered by a skilled person in the art within the scope of the claims. An embodiment derived from a proper combination of technical means disclosed in different embodiments is also encompassed in the technical scope of the present invention.

INDUSTRIAL APPLICABILITY

The present invention can be suitably used in a mobile miniature wireless device.

REFERENCE SIGNS LIST

100, 100', 100": antenna device
101, 101', 101": antenna element
102, 102', 102": electric conductor plate
103, 103', 103": dielectric
111, 111*b* through 111*g*: first antenna section
112, 112*b* through 112*g*: second antenna section
113, 113*b* through 113*g*: wind section
114, 114*b* through 114*c*: feed section
116, 116*b*, 116*c*: inductance matching pattern (wider width section)
121, 121', 121": feed line
122, 122', 122": outer electric conductor
123, 123', 123": inner electric conductor
104": short-circuit material

The invention claimed is:

1. An antenna device, comprising:

an antenna element constituting a plane; and an electric conductor plate provided so as to face the antenna element, the antenna element and the electric conductor plate being short-circuited, and the antenna element being directly connected with a pair of electric conductors constituting a feed line, wherein:

the antenna element has a path which continues from one end part of the antenna element to the other end part of the antenna element;

the one and the other end parts of the antenna element are connected with the respective pair of electric conductors constituting the feed line;

the antenna element has a wind section made up of (a) a first root section including the one end part of the antenna element and (b) a second root section including the other end part of the antenna element;

the first root section and the second root section (c) surround a feed section with which the pair of electric conductors constituting the feed line are connected and (d) are drawn out in respective opposite directions;

the first root section has (i) a first linear part that extends in a first direction from the one end part of the antenna element, (ii) a first bending part that extends, from an end part of the first linear part, in a second direction perpendicular to the first direction, (iii) a second linear part that extends, from an end part of the first bending part, in a direction opposite to the first direction, (iv) a second bending part that extends, from an end part of the second linear part, in a direction opposite to the second direction, and (v) a third linear part that extends, from an end part of the second bending part, in the first direction; and the second root section has (vi) a fourth linear part that extends, from the other end part of the antenna element, in the direction opposite to the first direction, (vii) a third bending part that extends, from an end part of the fourth linear part, in the direction opposite to the second direction, (viii) a fifth linear part that extends, from an end part of the third bending part, in the first direction, (ix) a fourth bending part that extends, from an end part of the fifth linear part, in the second direction, and (x) a sixth linear part that extends, from an end part of the fourth bending part, in the direction opposite to the first direction, wherein the antenna element has:

a first antenna section that continues to the first root section and has a meander shape whose return direction is perpendicular to the first direction; and a second antenna section that continues to the second root section, extends in the first direction, and has a linear shape.

2. An antenna device, comprising:

an antenna element constituting a plane; and an electric conductor plate provided so as to face the antenna element, the antenna element and the electric conductor plate being short-circuited, and the antenna element being directly connected with a pair of electric conductors constituting a feed line, wherein:

the antenna element has a path which continues from one end part of the antenna element to the other end part of the antenna element;

the one and the other end parts of the antenna element are connected with the respective pair of electric conductors constituting the feed line;

the antenna element has a wind section made up of (a) a first root section including the one end part of the antenna element and (b) a second root section including the other end part of the antenna element;

the first root section and the second root section (c) surround a feed section with which the pair of electric conductors constituting the feed line are connected and (d) are drawn out in respective opposite directions;

the first root section has (i) a first linear part that extends in a first direction from the one end part of the antenna element, (ii) a first bending part that extends, from an end part of the first linear part, in a direction perpendicular to the first direction, and (iii) a second linear part that extends, from an end part of the first bending part, in a direction opposite to the first direction; and the second root section has (iv) a third linear part that extends, from the other end of the antenna element, in the direction opposite to the first direction, (v) a second bending part that extends, from an end part of the third linear part, in a direction opposite to the second direction, and (vi) a fourth linear part that extends in the first direction from an end part of the second bending part, wherein the antenna element has:

a first antenna section that continues to the first root section and has a meander shape whose return direction is parallel to the first direction; and a second antenna section that continues to the second root section and has a meander shape whose return direction is perpendicular to the first direction.

3. An antenna device, comprising:

an antenna element constituting a plane; and an electric conductor plate provided so as to face the antenna element, the antenna element and the electric conductor plate being short-circuited, and the antenna element being directly connected with a pair of electric conductors constituting a feed line, wherein:

the antenna element has a path which continues from one end part of the antenna element to the other end part of the antenna element;

the one and the other end parts of the antenna element are connected with the respective pair of electric conductors constituting the feed line;

the antenna element has a wind section made up of (a) a first root section including the one end part of the antenna element and (b) a second root section including the other end part of the antenna element;

the first root section and the second root section (c) surround a feed section with which the pair of electric conductors constituting the feed line are connected and (d) are drawn out in respective opposite directions;

the first root section has (i) a first linear part that extends in a first direction from the one end part of the antenna element, (ii) a first bending part that extends, from an end part of the first linear part, in a direction perpendicular to the first direction, and (iii) a second linear part that extends, from an end part of the first bending part, in a direction opposite to the first direction; and the second root section has (iv) a third linear part that extends, from the other end of the antenna element, in the direction opposite to the first direction, (v) a second bending part that extends, from an end part of the third linear part, in a direction opposite to the second direction, and (vi) a fourth linear part that extends in the first direction from an end part of the second bending part, wherein the antenna element has:

a first antenna section that continues to the first root section and has a meander shape whose return direction is parallel to the first direction; and a second antenna section that continues to the second root section and has a meander shape whose return direction is parallel to the first direction.

4. The antenna device as set forth in claim 3, wherein the antenna element has a branch provided between the first antenna section and the second antenna section.

5. The antenna device as set forth in claim 3, wherein spacing between the first antenna section and the second antenna section is greater than a length of the first linear part.

* * * * *